US009682566B2

(12) United States Patent
Mizutani et al.

(10) Patent No.: US 9,682,566 B2
(45) **Date of Patent: *Jun. 20, 2017**

(54) LIQUID SUPPLY UNIT

(71) Applicant: SEIKO EPSON CORPORATION, Tokyo (JP)

(72) Inventors: Tadahiro Mizutani, Shiojiri (JP); Atsushi Kobayashi, Matsumoto (JP); Shun Oya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/964,976

(22) Filed: Dec. 10, 2015

(65) Prior Publication Data

US 2016/0089892 A1 Mar. 31, 2016

Related U.S. Application Data

(63) Continuation of application No. 14/573,516, filed on Dec. 17, 2014, now Pat. No. 9,233,547.

(30) Foreign Application Priority Data

| | | |
|---|---|---|
| Dec. 18, 2013 | (JP) | 2013-260964 |
| Dec. 26, 2013 | (JP) | 2013-270007 |
| Dec. 27, 2013 | (JP) | 2013-272477 |
| Jan. 30, 2014 | (JP) | 2014-015767 |
| Feb. 3, 2014 | (JP) | 2014-018365 |
| Feb. 19, 2014 | (JP) | 2014-029769 |

(Continued)

(51) Int. Cl.
*B41J 2/175* (2006.01)
*B41J 2/17* (2006.01)

(52) U.S. Cl.
CPC ..... *B41J 2/1752* (2013.01); *B41J 2/175* (2013.01); *B41J 2/1714* (2013.01); *B41J 2/1753* (2013.01);

(Continued)

(58) Field of Classification Search
USPC ..... 347/85, 86, 87, 89
See application file for complete search history.

(56) References Cited

U.S. PATENT DOCUMENTS

| | | | |
|---|---|---|---|
| 4,556,012 | A | 12/1985 | Scrudato |
| 5,182,581 | A | 1/1993 | Kashimura et al. |

(Continued)

FOREIGN PATENT DOCUMENTS

| | | | |
|---|---|---|---|
| CN | 103204005 | A | 7/2013 |
| EP | 0993954 | A2 | 4/2000 |

(Continued)

*Primary Examiner* — Lam Nguyen
(74) *Attorney, Agent, or Firm* — Stroock & Stroock & Lavan LLP

(57) ABSTRACT

Cartridges 4 and 5 are configured, such that first convex ribs 428*a* and 528*a* abut against second wall surfaces 762 of cartridge engagement wall surfaces 760 inclined with respect to a bottom wall 712 of a cartridge attachment structure 7 and move in friction with the second wall surfaces 762. Such abutting and moving causes contact portions of terminals 412 and 512 of circuit substrates 410 and 510 of the respective cartridges 4 and 5 to come into contact with electrode assemblies 810 of a carriage 8. This configuration enhances the reliability of electric connection between a contact portion, such as a circuit substrate, of a liquid supply unit and an electrode assembly, such as contact pins, of a carriage in the course of attachment.

15 Claims, 28 Drawing Sheets

(30) Foreign Application Priority Data

| | | |
|---|---|---|
| Feb. 21, 2014 | (JP) | 2014-031192 |
| Feb. 26, 2014 | (JP) | 2014-034847 |
| Feb. 28, 2014 | (JP) | 2014-037928 |
| Feb. 28, 2014 | (JP) | 2014-037929 |
| Mar. 7, 2014 | (JP) | 2014-045198 |
| Mar. 20, 2014 | (JP) | 2014-057360 |
| Mar. 25, 2014 | (JP) | 2014-061295 |
| Mar. 25, 2014 | (JP) | 2014-061296 |
| Mar. 25, 2014 | (JP) | 2014-061297 |
| Jun. 9, 2014 | (JP) | 2014-118344 |

(52) U.S. Cl.
CPC ..... *B41J 2/17523* (2013.01); *B41J 2/17526* (2013.01); *B41J 2/17553* (2013.01)

(56) References Cited

U.S. PATENT DOCUMENTS

| | | | |
|---|---|---|---|
| 5,488,401 | A | 1/1996 | Mochizuki et al. |
| 5,552,861 | A | 9/1996 | Mizude et al. |
| 5,619,239 | A | 4/1997 | Kotaki et al. |
| 6,000,789 | A | 12/1999 | Takagi et al. |
| 6,152,555 | A | 11/2000 | Nozawa et al. |
| 6,170,941 | B1 | 1/2001 | Hara et al. |
| 6,250,750 | B1 | 6/2001 | Miyazawa et al. |
| 6,276,780 | B1 | 8/2001 | Carrese et al. |
| 6,302,530 | B1 | 10/2001 | Shimada et al. |
| 6,375,315 | B1 | 4/2002 | Steinmetz et al. |
| 6,416,152 | B1 | 7/2002 | Matsuzaki et al. |
| 6,439,491 | B1 | 8/2002 | Liao |
| 6,502,917 | B1 | 1/2003 | Shinada et al. |
| 6,739,708 | B2 | 5/2004 | Studer et al. |
| 6,776,479 | B2 | 8/2004 | Ardito et al. |
| 6,899,417 | B1 | 5/2005 | Shinada et al. |
| 7,178,909 | B2 | 2/2007 | Yoshiyama et al. |
| 7,258,431 | B2 | 8/2007 | Shimada et al. |
| 7,300,142 | B1 | 11/2007 | Usui et al. |
| RE41,601 | E | 8/2010 | Matsuzaki et al. |
| 8,297,738 | B1 | 10/2012 | Kodama et al. |
| 8,297,739 | B1 | 10/2012 | Kodama et al. |
| 8,439,482 | B1 | 5/2013 | Kodama et al. |
| 8,540,347 | B2 | 9/2013 | Ishizawa et al. |
| 2002/0118262 | A1 | 8/2002 | Seino et al. |
| 2002/0158948 | A1 | 10/2002 | Miyazawa et al. |
| 2002/0167574 | A1 | 11/2002 | Shinada et al. |
| 2002/0171700 | A1 | 11/2002 | Shinada et al. |
| 2002/0171701 | A1 | 11/2002 | Shinada et al. |
| 2002/0180823 | A1 | 12/2002 | Shinada et al. |
| 2003/0058296 | A1 | 3/2003 | Shinada et al. |
| 2003/0085969 | A1 | 5/2003 | Shinada et al. |
| 2004/0246304 | A1 | 12/2004 | Takahashi et al. |
| 2004/0246317 | A1 | 12/2004 | Hayashi et al. |
| 2005/0146576 | A1 | 7/2005 | Shinada et al. |
| 2005/0168549 | A1 | 8/2005 | Shinada et al. |
| 2005/0195255 | A1 | 9/2005 | Shinada et al. |
| 2006/0033790 | A1 | 2/2006 | Shinada et al. |
| 2006/0066696 | A1 | 3/2006 | Matsumoto et al. |
| 2006/0119677 | A1 | 6/2006 | Shinada et al. |
| 2006/0203050 | A1 | 9/2006 | Shinada et al. |
| 2006/0290757 | A1 | 12/2006 | Shinada et al. |
| 2007/0247501 | A1 | 10/2007 | Shinada et al. |
| 2008/0049080 | A1 | 2/2008 | Hayashi et al. |
| 2008/0049081 | A1 | 2/2008 | Hayashi et al. |
| 2008/0284830 | A1 | 11/2008 | Shinada et al. |
| 2009/0009560 | A1 | 1/2009 | Shinada et al. |
| 2009/0027453 | A1 | 1/2009 | Shinada et al. |
| 2009/0040274 | A1 | 2/2009 | Shinada et al. |
| 2009/0040275 | A1 | 2/2009 | Shinada et al. |
| 2011/0273520 | A1 | 11/2011 | Shinada et al. |
| 2013/0182046 | A1 | 7/2013 | Kodama et al. |
| 2013/0182047 | A1 | 7/2013 | Nozawa et al. |
| 2013/0182048 | A1 | 7/2013 | Nozawa et al. |
| 2013/0182049 | A1 | 7/2013 | Kodama et al. |
| 2013/0182052 | A1 | 7/2013 | Matsuzaki et al. |
| 2013/0182053 | A1 | 7/2013 | Kodama et al. |
| 2014/0152746 | A1 | 6/2014 | Kodama et al. |
| 2014/0210917 | A1 | 7/2014 | Kodama et al. |
| 2014/0368585 | A1 | 12/2014 | Nozawa et al. |
| 2015/0077486 | A1 | 3/2015 | Kodama et al. |
| 2016/0129696 | A1 | 5/2016 | Nozawa et al. |
| 2016/0375688 | A1 | 12/2016 | Kodama et al. |

FOREIGN PATENT DOCUMENTS

| | | | |
|---|---|---|---|
| JP | 07-148936 | A | 6/1995 |
| JP | 09-011500 | A | 1/1997 |
| JP | 10-016249 | A | 1/1998 |
| JP | 10-235890 | A | 9/1998 |
| JP | 10-278290 | A | 10/1998 |
| JP | 10-286972 | A | 10/1998 |
| JP | 2000-033707 | A | 2/2000 |
| JP | 2000-190522 | A | 7/2000 |
| JP | 2001-121715 | A | 5/2001 |
| JP | 2001-253087 | A | 9/2001 |
| JP | 2001-277534 | A | 10/2001 |
| JP | 3248831 | B | 11/2001 |
| JP | 2002-292905 | A | 10/2002 |
| JP | 2003-072099 | A | 3/2003 |
| JP | 2003-520713 | A | 7/2003 |
| JP | 2004-209662 | A | 7/2004 |
| JP | 2004-230704 | A | 8/2004 |
| JP | 2004-358914 | A | 12/2004 |
| JP | 2005-028883 | A | 2/2005 |
| JP | 2005-125559 | A | 5/2005 |
| JP | 2006-088650 | A | 4/2006 |
| JP | 2006-175885 | A | 7/2006 |
| JP | 2006-247932 | A | 9/2006 |
| JP | 2006-289770 | A | 10/2006 |
| JP | 2008-074090 | A | 4/2008 |
| JP | 2008-074100 | A | 4/2008 |
| JP | 2008279783 | A | 11/2008 |
| JP | 2013-141804 | A | 7/2013 |
| JP | 2013-158980 | A | 8/2013 |
| WO | 01/54912 | A1 | 8/2001 |

LIQUID SUPPLY UNIT

CROSS REFERENCE TO RELATED APPLICATIONS

This application is a continuation application of U.S. patent application Ser. No. 14/573,516, filed on Dec. 17, 2014. This application claims priorities to Japanese Patent Applications No. (JP) 2013-260964 filed on Dec. 18, 2013, JP 2013-270007 filed on Dec. 26, 2013, JP 2013-272477 filed on Dec. 27, 2013, JP 2014-015767 filed on Jan. 30, 2014, JP 2014-18365 filed on Feb. 3, 2014, JP 2014-29769 filed on Feb. 19, 2014, JP 2014-31192 filed on Feb. 21, 2014, JP 2014-34847 filed on Feb. 26, 2014, JP 2014-37928 filed on Feb. 28, 2014, JP 2014-37929 filed on Feb. 28, 2014, JP 2014-45198 filed on Mar. 7, 2014, JP 2014-57360 filed on Mar. 20, 2014, JP 2014-61295 filed on Mar. 25, 2014, JP 2014-61296 filed on Mar. 25, 2014, JP 2014-61297 filed on Mar. 25, 2014, and JP 2014-118344 filed on Jun. 9, 2014, entire disclosures of which are incorporated herein by reference for all purposes.

BACKGROUND

The present invention relates to a liquid supply unit.

An ink cartridge (also simply called "cartridge") configured to supply ink to a printer as an example of a liquid ejection device has been known conventionally as a liquid supply unit configured to supply a liquid to the liquid ejection device. Ink contained in the cartridge is gradually consumed with the progress of printing. Data regarding, for example, the remaining amount of ink is transmitted between the cartridge and the printer. For the purpose of such data communication, a technique has been proposed to press the cartridge against the printer or more specifically against a carriage, in order to generally maintain the contact between an electrode assembly of the printer and a contact portion of the cartridge as described in Japanese Patent Publication (JP 2008-74090A).

SUMMARY

In the cartridge proposed in JP 2008-74090A, a contact portion (more specifically a circuit substrate) is pressed against an electrode assembly (more specifically contact pins) of the carriage in the course of attachment of the cartridge to the carriage. There is a need for further improvement in electric connection between the circuit substrate and the contact pins in the course of attachment as described below.

In the course of attachment of the cartridge, the circuit substrate abuts against and thereby comes into contact with the contact pins. If any foreign substance is present at the contact portions on the surface of contact terminals of the circuit substrate or on the surface of the contact pins which are to be in contact with the contact portions, the contact portions come into contact with the contact pins via the foreign substance. This may reduce the reliability of electric contact. A wiping operation is accordingly performed in such a manner that the contact pin frictions the surface of the contact terminals by a predetermined distance for the purpose of removing the foreign substance. The excessively long distance of wiping, however, causes a problem that the surface of the circuit substrate without the connection terminals is scraped off to generate foreign substance. There is accordingly a need to enhance the reliability of electric contact between the contact portion and the electrode assembly in the course of attachment of a liquid supply unit such as a cartridge. In a liquid supply unit configured to contain and supply a liquid, a liquid ejection device configured to receive supply of a liquid from the liquid supply unit and a system including the liquid supply unit and the liquid ejection device, there are other needs including downsizing, cost reduction, resource saving, easy manufacture and improvement of usability.

In order to solve at least part of the problems described above, the invention may be implemented by aspects described below.

(1) According to one aspect of the invention, there is provided a liquid supply unit. The liquid supply unit is mountable to and demountable from an attachment structure comprising a bottom wall, a side wall arranged to intersect with the bottom wall, an end wall arranged to intersect with the bottom wall and the side wall and an electrode assembly provided at a position opposed to the end wall. The liquid supply unit comprises a first surface member, a second surface member, a third surface member and a contact portion. In an attachment state that the liquid supply unit is attached to the attachment structure, the first surface member faces the bottom wall, the second surface member faces the side wall, the third surface member faces the end wall, and the contact portion is electrically connectable with the electrode assembly. The second surface member has a restriction portion configured to restrict a distance of friction of the contact portion against the electrode assembly in the course of attachment of the liquid supply unit to the attachment state.

The liquid supply unit of this aspect performs wiping since some foreign substance is likely to be present on the surface of the contact portion of the liquid supply unit and on the surface of the electrode assembly of the attachment structure. In the liquid supply unit of this aspect, the contact portion frictions the electrode assembly, while the restriction portion restricts the change in attitude of the liquid supply unit against the attachment structure in the course of attachment. This limits the distance of wiping to a desired range. As a result, this configuration enhances the reliability of electric connection between the contact portion and the electrode assembly in the course of attachment.

(2) In the liquid supply unit of the above aspect, the restriction portion may restrict a direction in which the contact portion comes into contact with the electrode assembly in the course of attachment. This configuration increases the accuracy of the location where wiping starts and thereby suppresses a problem that the wiping range is unnecessarily expanded.

(3) In the liquid supply unit of the above aspect, the restriction portion may be a first convex protruded outward from the second surface member, and the first convex may be arranged to come into contact with a wall surface part of the side wall which is extended in a direction of intersecting with the first surface member and the second surface member in the attachment state and thereby restrict a change in attitude of the liquid supply unit against the attachment structure. This configuration increases the accuracy of wiping by the simple technique that the first convex comes into contact with the wall surface part of the side wall.

(4) In the liquid supply unit of the above aspect, the third surface member may have an engagement element configured to be engageable with the end wall and to restrict the change in attitude of the liquid supply unit against the attachment structure in the course of attachment, and the first convex may be arranged to come into contact with an inclined wall surface of the side wall inclined with respect to the bottom wall after engagement of the engagement portion with the end wall and thereby start friction of the contact portion against the electrode assembly. The liquid supply unit of this aspect is attached to the attachment structure by the sequential steps that the engagement portion is engaged with the end wall and the first convex subsequently comes into contact with the inclined wall surface of the side wall. This enhances the attachment of the liquid supply unit.

(5) In the liquid supply unit of the above aspect, an angle of the inclined wall surface with respect to the bottom wall may be set equal to an angle of the contact portion in a direction of coming into contact with the electrode assembly with respect to the bottom wall, and the first convex may be arranged such that a direction in which the first convex is in friction with the inclined wall surface after coming into contact with the inclined wall surface is equal to a direction in which the contact portion approaches to the electrode assembly. This configuration allows for wiping more effectively and more easily.

(6) In the liquid supply unit of the above aspect, the side wall may have a perpendicular wall surface which is located closer to the bottom wall than the inclined wall surface and is arranged to be perpendicular to the bottom wall, and the first convex may be arranged to come into contact with the perpendicular wall surface after coming into contact with the inclined wall surface of the side wall and thereby keep the contact portion in contact with the electrode assembly. This configuration allows for positioning the liquid supply unit in a direction toward the third surface member, while ensuring wiping.

(7) In the liquid supply unit of the above aspect, the second surface member may have a second convex protruded outward from the second surface member, and the second convex may be located closer to the third surface member than the first convex in a plan view of the liquid supply unit in a direction toward the second surface member. The second convex located on the third surface member side coming into contact with the side wall guides attachment of the liquid supply unit and thereby enhances the attachment of the liquid supply unit.

(8) According to another aspect of the invention, there is provided a liquid supply unit. The liquid supply unit is mountable to and demountable from an attachment structure comprising a bottom wall, a side wall arranged to intersect with the bottom wall, an end wall arranged to intersect with the bottom wall and the side wall and an electrode assembly provided at a position opposed to the end wall. The liquid supply unit comprises a first surface member, a second surface member, a third surface member and a contact portion. In an attachment state that the liquid supply unit is attached to the attachment structure, the first surface member faces the bottom wall, the second surface member faces the side wall, the third surface member faces the end wall, and the contact portion is electrically connectable with the electrode assembly. The second surface member has a first convex and a second convex protruded outward from the second surface member. The second convex is located closer to the third surface member than the first convex in a plan view of the liquid supply unit in a direction toward the second surface member. The first convex is arranged to come into contact with a wall surface part of the side wall which is extended in a direction of intersecting with the first surface member and the second surface member in the attachment state and is configured to restrict a distance of friction of the contact portion against the electrode assembly in the course of attachment of the liquid supply unit to the attachment state. The second convex is arranged to come into contact with the side wall in the course of attachment and thereby guide attachment of the liquid supply unit.

The liquid supply unit of this aspect allows for wiping by the simple technique that the first convex comes into contact with the wall surface part of the side wall. The second convex located on the third surface member side coming into contact with the side wall guides attachment of the liquid supply unit and thereby enhances the attachment of the liquid supply unit.

(9) In the liquid supply unit of the above aspect, the second surface member may have a third convex protruded outward from the second surface member, and the third convex may be located on an opposite side of the second convex across the first convex in the plan view of the liquid supply unit in the direction toward the second surface member. In this configuration, the distance between the first convex and the second convex may differ from the distance between the first convex and the third convex. No problem thus arises in the course of attachment of the liquid supply unit in the attitude that the second convex is located on the end wall side of the attachment structure. In the attitude that the third convex is located on the end wall side of the attachment structure, however, the first convex interferes with the side wall. This configuration accordingly prevents wrong attachment of the liquid supply unit.

(10) In the liquid supply unit of the above aspect, in the plan view of the liquid supply unit in the direction toward the second surface member, a distance from the first surface member to the second convex may be greater than a distance from the first surface member to the third convex. This more effectively prevents wrong attachment of the liquid supply unit.

(11) The liquid supply unit of the above aspect may further comprise: a fourth surface member arranged to intersect with the first surface member and the third surface member and opposed to the second surface member; a fifth surface member arranged to intersect with the first surface member, the second surface member and the fourth surface member and opposed to the third surface member; and a sixth surface member arranged to intersect with the second surface member, the third surface member, the fourth surface member and the fifth surface member and opposed to the first surface member. The attachment structure may have another side wall provided at a location opposed to the side wall and arranged to intersect with the bottom wall. The fourth surface member may have another first convex protruded outward from the fourth surface member and may be arranged to face the another side wall in the attachment state. The another first convex may be arranged to come into contact with another wall surface part of the another side wall which is extended in a direction of intersecting with the first surface member and the fourth surface member in the attachment state and may be configured to come into contact with the another wall surface part and thereby restrict a change in attitude of the liquid supply unit such that the contact portion moves in friction with the electrode assembly in the course of attachment. The first convexes come into contact with the wall surface parts of the side walls on both the second surface member side and the fourth surface member side opposed to the second surface member side. This allows for wiping with high accuracy.

All the plurality of components included in the aspect of the invention described above are not essential, but some components among the plurality of components may be appropriately changed, omitted or replaced with other components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the invention described above may be combined with part or all of the technical features included in another aspect of the invention described later to provide still another independent aspect of the invention.

The invention may be implemented by any of various other aspects: for example, a liquid ejection device configured to receive supply of a liquid from the liquid supply unit and a system including the liquid supply unit and the liquid ejection device.

DESCRIPTION OF EMBODIMENTS

Some aspects of the invention are described below

A. Embodiment

A-1. Configuration of Liquid Ejection System 1

Figure 1:
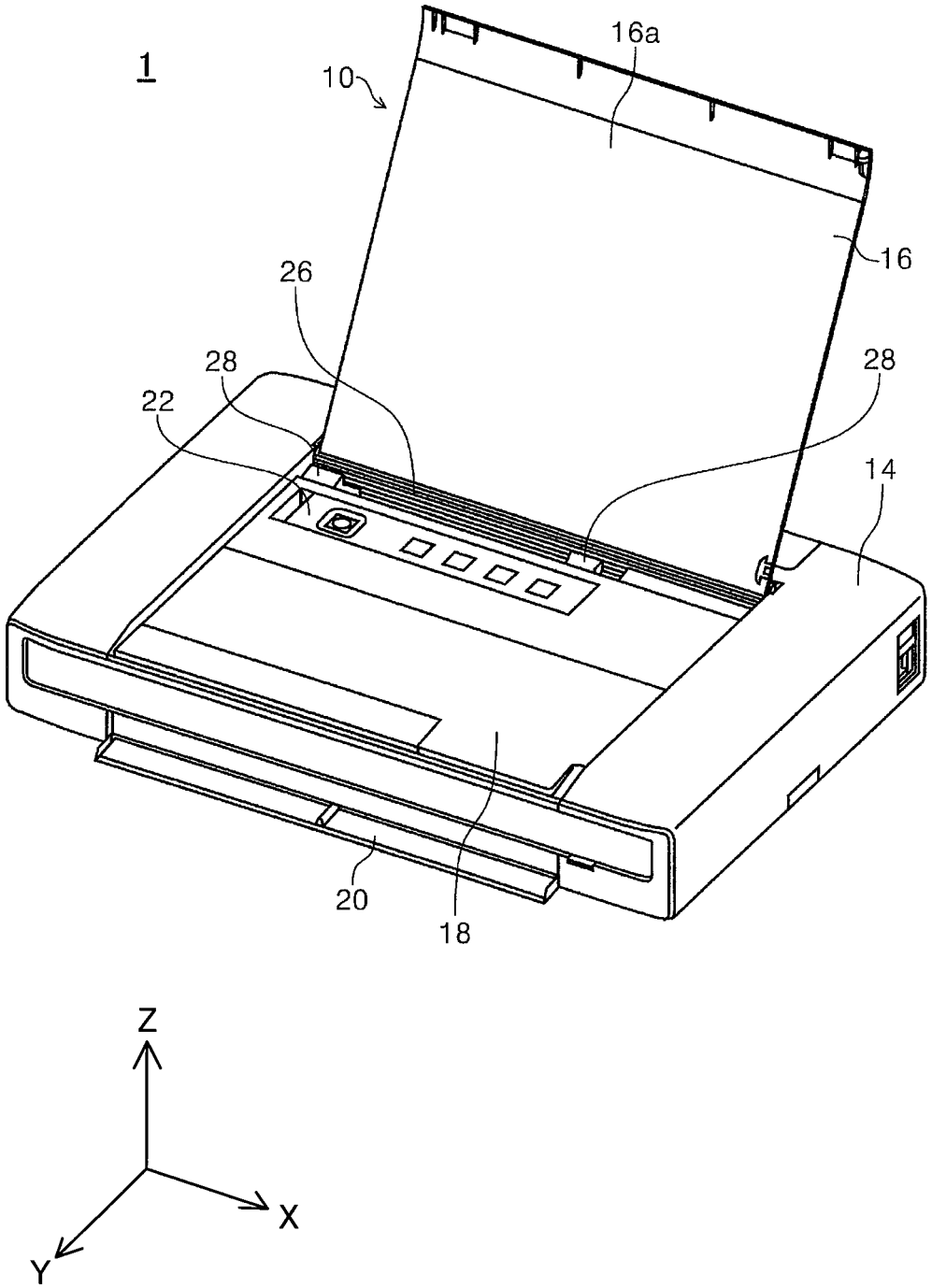
FIG. 1 is a perspective view illustrating the general configuration of a liquid ejection system.
Figure 2:
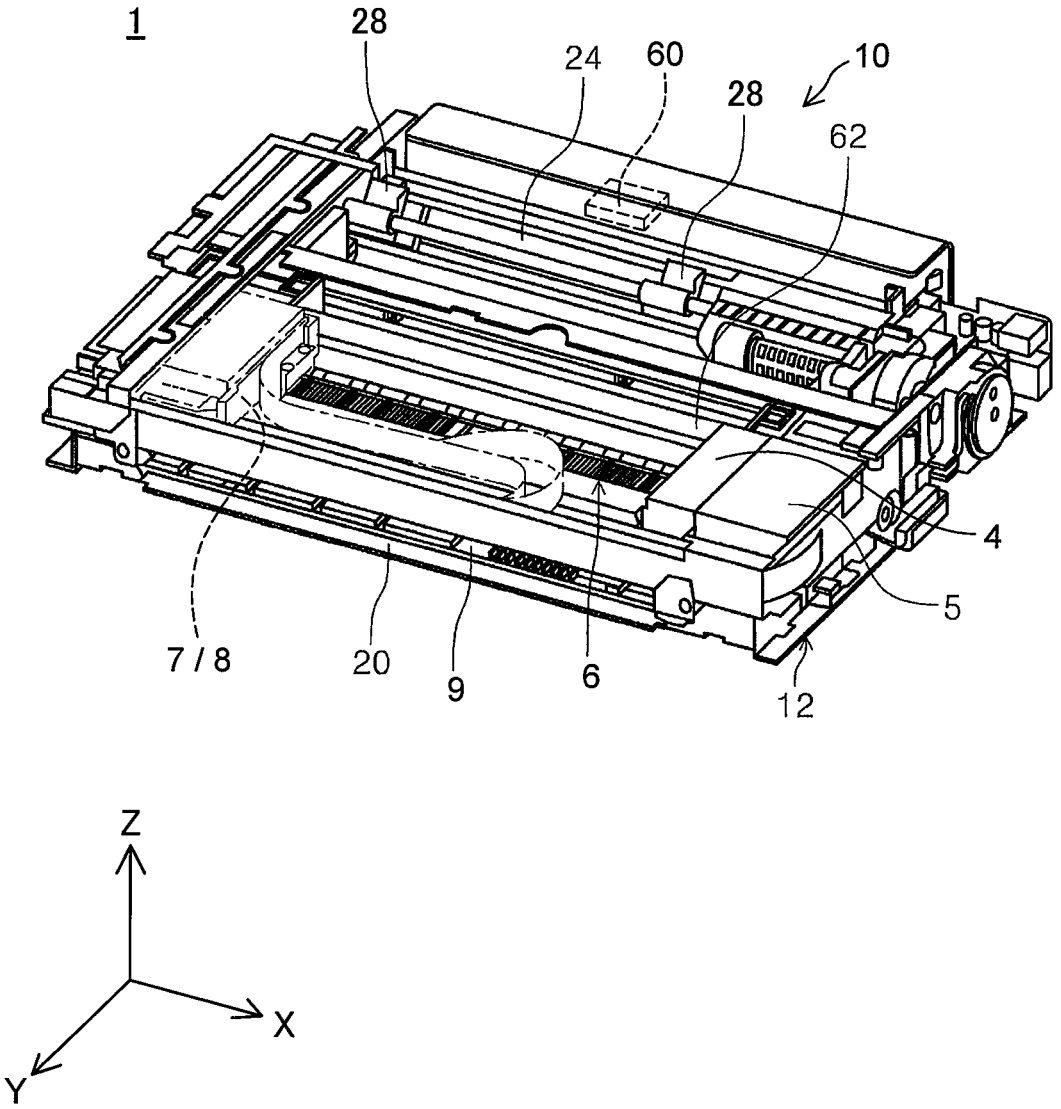
FIG. 2 is a perspective view schematically illustrating the internal configuration of the liquid ejection system.

FIG. 1 is a perspective view illustrating the general configuration of a liquid ejection system 1, and FIG. 2 is a perspective view schematically illustrating the internal configuration of the liquid ejection system 1. XYZ axes orthogonal to one another are shown in FIGS. 1 and 2. The X axis denotes an axis along a direction in which a carriage 8 described later moves back and force and is more specifically an axis along a main scan direction of printing accompanied with the back and forth motion of the carriage 8. The Y axis denotes an axis along a feed path direction of paper sheets in the liquid ejection system 1 placed on a horizontal plane such as desk and is more specifically an axis along a sub scan direction of printing accompanied with the back and forth motion of the carriage 8. The Z axis denotes an axis along the top-bottom direction of the liquid ejection system 1 placed on the horizontal plane such as desk. In other illustrations subsequent to FIG. 2, the XYZ axes are shown as needed. The XYZ axes in FIGS. 1 and 2 correspond to the XYZ axes in the other illustrations. The liquid ejection system 1 includes a printer 10 as a liquid ejection device and two different types of cartridges 4 and 5. As shown in FIG. 2, in the liquid ejection system 1 of this embodiment, the cartridges 4 and 5 are attachable to and detachable from a cartridge attachment structure 7 of the printer 10. The cartridge attachment structure 7 is mounted on a carriage 8 equipped with an ejection head 8*s* for ink ejection (FIG. 7) and is generally integrated with the carriage 8. In the description below, the cartridge 4 is called "first cartridge 4" and the cartridge 5 is called "second cartridge 5".

The first cartridge 4 contains a single color ink, for example, black ink. The second cartridge 5 contains a plurality of different color inks and includes three liquid containing parts according to this embodiment. The second cartridge 5 of this embodiment contains three different color inks, yellow, magenta and cyan.

The number of cartridges and the types of cartridges attached to the cartridge attachment structure 7 are, however, not limited to the configuration of this embodiment. For example, four first cartridges 4 may be provided corresponding to four different color inks, black, cyan, magenta and yellow and may be attached to the cartridge attachment structure 7. In another example, a cartridge containing another or other color inks (for example, light magenta and light cyan) may be attached to the cartridge attachment structure 7. In the application that the multiple first cartridges 4 are attached corresponding to the respective color inks, attachment of the second cartridge 5 may be omitted.

The printer 10 is an inkjet printer. As shown in FIG. 1, the printer 10 includes a housing 14, a paper feeding unit cover 16, a recording unit protective cover 18, a paper output unit cover 20 and an operation unit 22. As shown in FIG. 2, the printer 10 has a device body 12.

As shown in FIG. 1, the housing 14 is arranged to surround the periphery of the device body 12 and forms the appearance of the printer 10. The paper feeding unit cover 16 is provided on an upper surface of the printer 10. The paper feeding unit cover 16 is placed on an upper surface of the housing 14 to be rotatable. The paper feeding unit cover 16 is movable between an open position relative to the housing 14 (FIG. 19 and a closed position (not shown). When the paper feeding unit cover 16 is at the closed position relative to the housing 14, the paper feeding unit cover 16, in combination with the upper surface of the housing 14, forms the upper surface of the printer 10.

When the paper feeding unit cover 16 is at the open position relative to the housing 14, the paper feeding unit cover 16 is inclined relative to a rear surface side (−Y-direction side) of the printer 10. In this state, a rear surface of the paper feeding unit cover 16 serves as a mounting surface 16*a* on which paper sheets are placed. When the paper feeding unit cover 16 is at the open position relative to the housing 14, a paper slot 26 of a paper feeding unit 24 included in the device body 12 as described later is open up in the printer 10. This accordingly enables the paper feeding unit 24 to feed the paper sheets placed on the mounting surface 16*a* to a paper feed path. The paper feed path denotes a paper moving path in the course of printing. The paper slot 26 has a pair of paper guides 28. The pair of paper guides 28 are arranged to adjust the interval in the width direction (X-axis direction) of the printer 10. The pair of paper guides 28 serve to fasten both ends of a paper sheet in the width direction and specify the position of the paper sheet in the width direction.

When the paper feeding unit cover 16 is at the open position relative to the housing 14, the recording unit protective cover 18 and the operation unit 22 are exposed to be accessible on the upper surface of the printer 10. The recording unit protective cover 18 is movable between an open position relative to the housing 14 (not shown) and a closed position (FIG. 1). When the recording unit protective cover 18 is at the open position relative to the housing 14, a recording unit 6 provided in the device body 12 is made accessible for the user.

The operation unit 22 is provided with a power button and print settings buttons for operating the printer 10. When the paper feeding unit cover 16 is at the open position relative to the housing 14, the operation unit 22 is made accessible for the user and allows the user to operate the printer 10.

Additionally, the paper output unit cover 20 is provided on a front surface of the housing 14. The paper output unit cover 20 is placed on the front surface of the housing 14 to be rotatable. The paper output unit cover 20 is movable between an open position relative to the housing 14 (FIG. 1) and a closed position (not shown). When the paper output unit cover 20 is at the open position relative to the housing 14, a paper sheet after recording discharged from a paper output unit 9 of the device body 12 is guided, by the paper output unit cover 20, toward the front side of the printer 10.

As illustrated in FIG. 2, the device body 12 includes the paper feeding unit 24, the recording unit 6, the paper output unit 9 and a controller 60.

The controller 60 is electrically connected with the paper feeding unit 24, the recording unit 6 and the paper output unit 9 and controls the operations of the respective units in response to instructions input from the operation unit 22. The controller 60 also controls the motion of the carriage 8 (motion in the X-axis direction: main scan drive) and the rotation of a feed roller shaft (sub-scan drive) via drive motors (not shown). The carriage 8 has the cartridge attachment structure 7 incorporated in its bottom. The controller 60 also transmits signals to and from circuit substrates included in the cartridges 4 and 5.

The device body 12 also includes a carriage guide rail 62 and a carriage driving unit (not shown) to make the carriage 8 movable along the carriage guide rail 62. The carriage guide rail 62 is extended in the X-axis direction, i.e., the width direction of the device body 12 and is placed in a bearing element 409 (FIG. 3) provided on the bottom side of the carriage 8 to support the carriage 8.

The carriage 8 having the cartridge attachment structure 7 mounted thereon is arranged to move back and forth in the width direction of the device body 12 (X-axis direction, main scan direction) by the carriage driving unit (not shown). The back and forth motion of the carriage 8 in the width direction of the device body 12 causes the cartridge attachment structure 7 to move back and forth in the width direction of the device body 12. The cartridges 4 and 5 are accordingly moved in a moving direction (X-axis direction) by the printer 10. The type of the printer 10 having the cartridges 4 and 5 attached to the cartridge attachment structure 7 provided on the carriage 8 for moving the ejection head like this embodiment is called "on-carriage type". In another application, a stationary cartridge attachment structure 7 may be provided at a different position from the carriage 8 to supply inks from the cartridges 4 and 5 attached to the cartridge attachment structure 7 to the ejection head of the carriage 8 via flexible tubes. This type of printer is called "off-carriage type". In this application, the cartridges 4 and 5 are not limited to detachable cartridges but may be stationary ink tanks. The ink tank may be provided with an ink filler port through which ink is injectable from outside.

In the use state of the liquid ejection system 1, the X axis denotes an axis along the main scan direction (left-right direction) in which the carriage 8 moves back and forth; the Y axis denotes an axis along the sub-scan direction (top-bottom direction) in which paper sheets are fed; and the Z axis denotes an axis along the vertical direction (top-bottom direction). Upward in the vertical direction is +Z direction, and downward in the vertical direction is −Z direction. The use state of the liquid ejection system 1 denotes the state of the liquid ejection system 1 placed on a horizontal plane. According to this embodiment, the horizontal plane is a plane parallel to the X axis and the Y axis (XY plane).

A-2. Cartridge Attachment State and Carriage Structure

Figure 3:
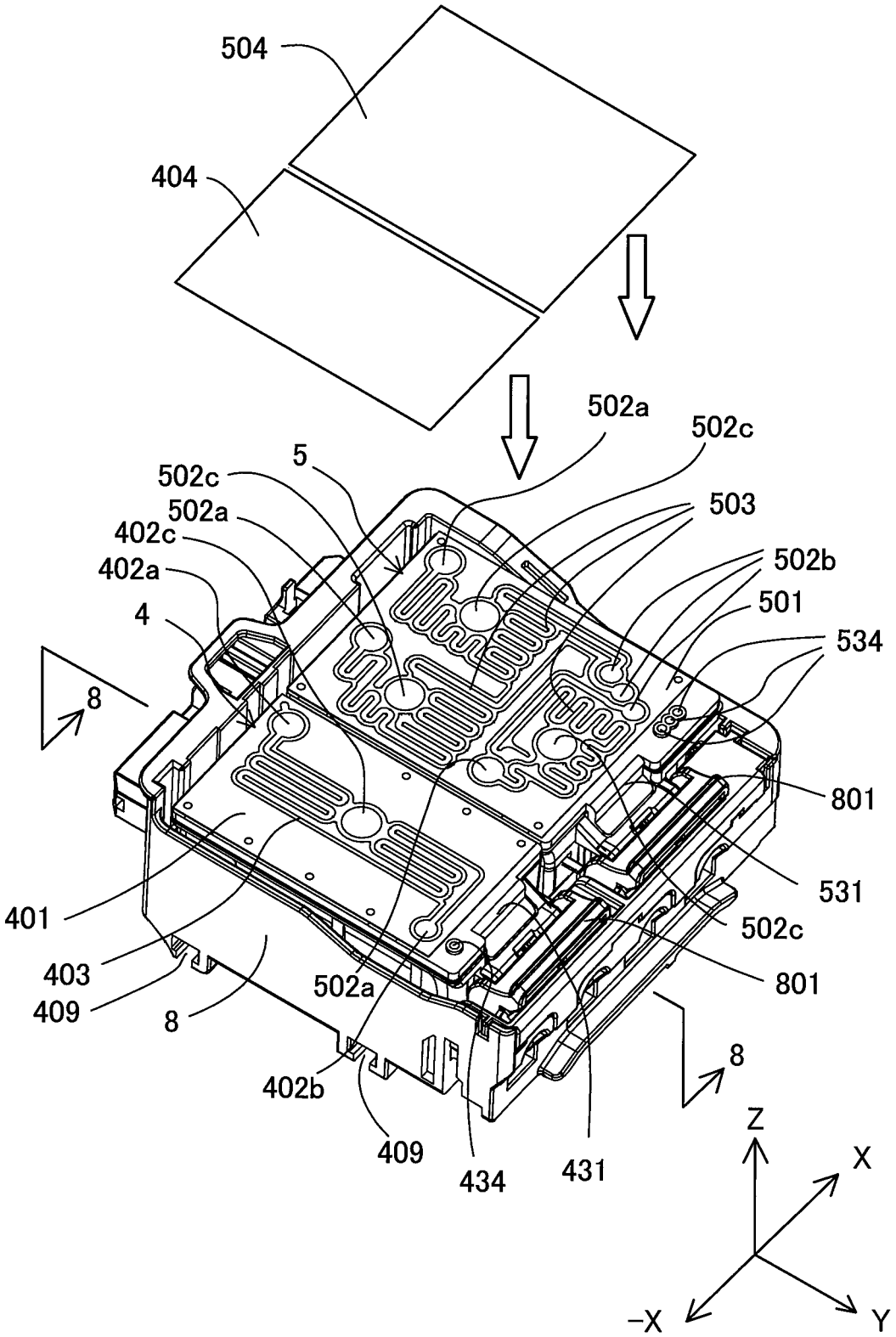
FIG. 3 is a perspective view schematically illustrating the appearance of a carriage in the cartridge attachment state.
Figure 4:
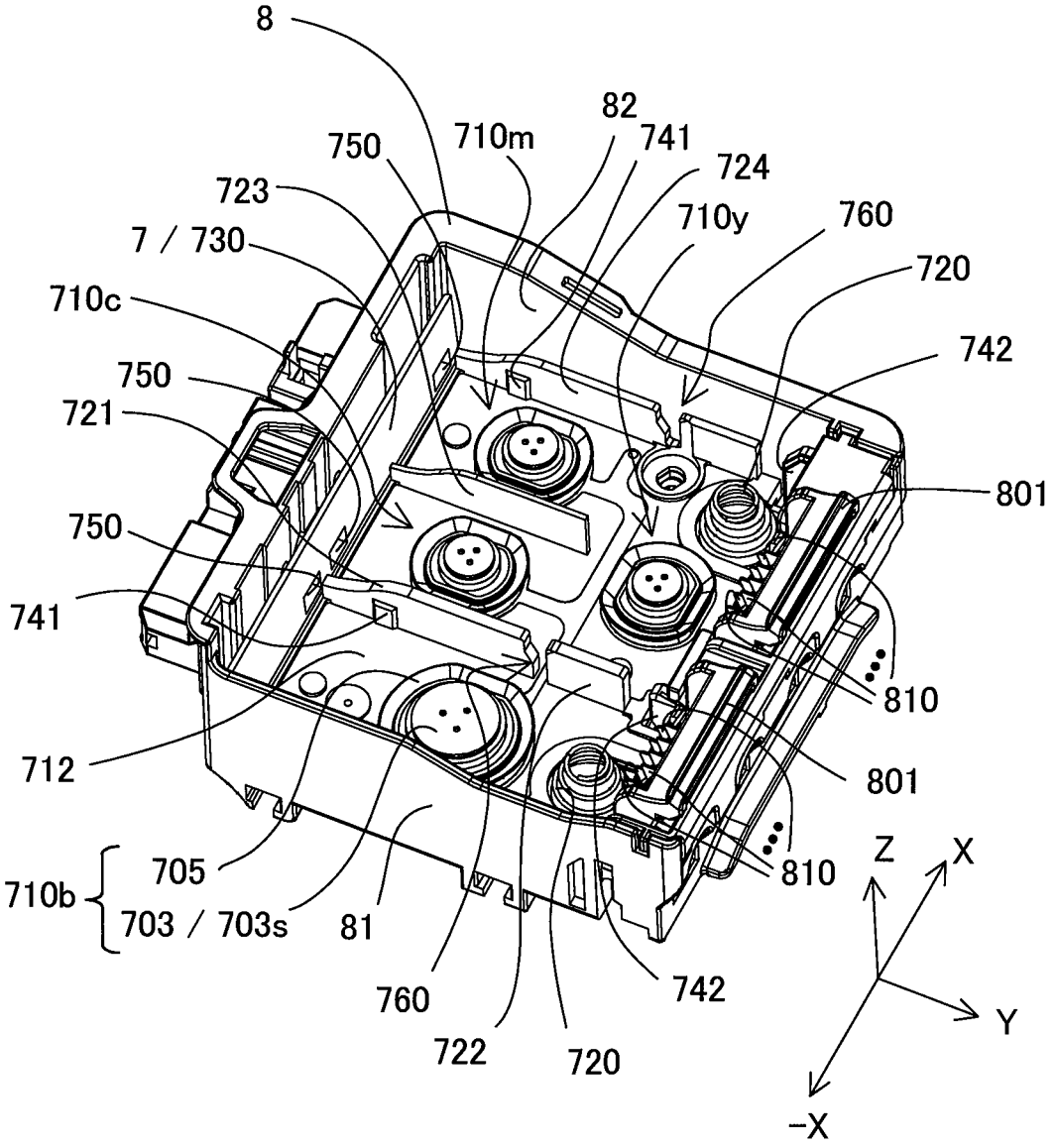
FIG. 4 is a schematic perspective view illustrating the carriage in the non-cartridge attachment state.
Figure 5:
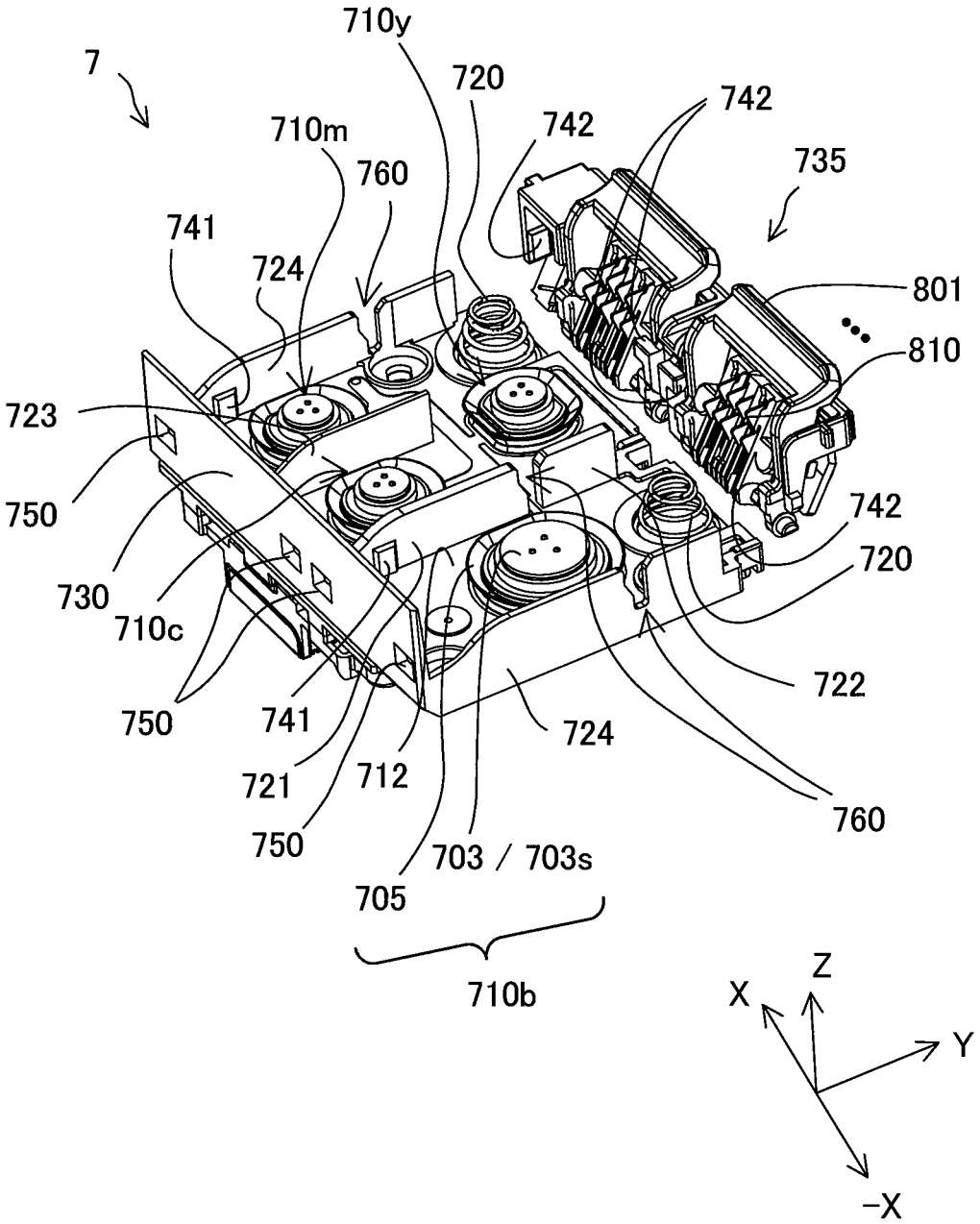
FIG. 5 is a schematic exploded perspective view illustrating a cartridge attachment structure in the non-cartridge attachment state, viewed in a different direction from that of FIG. 4.
Figure 6:
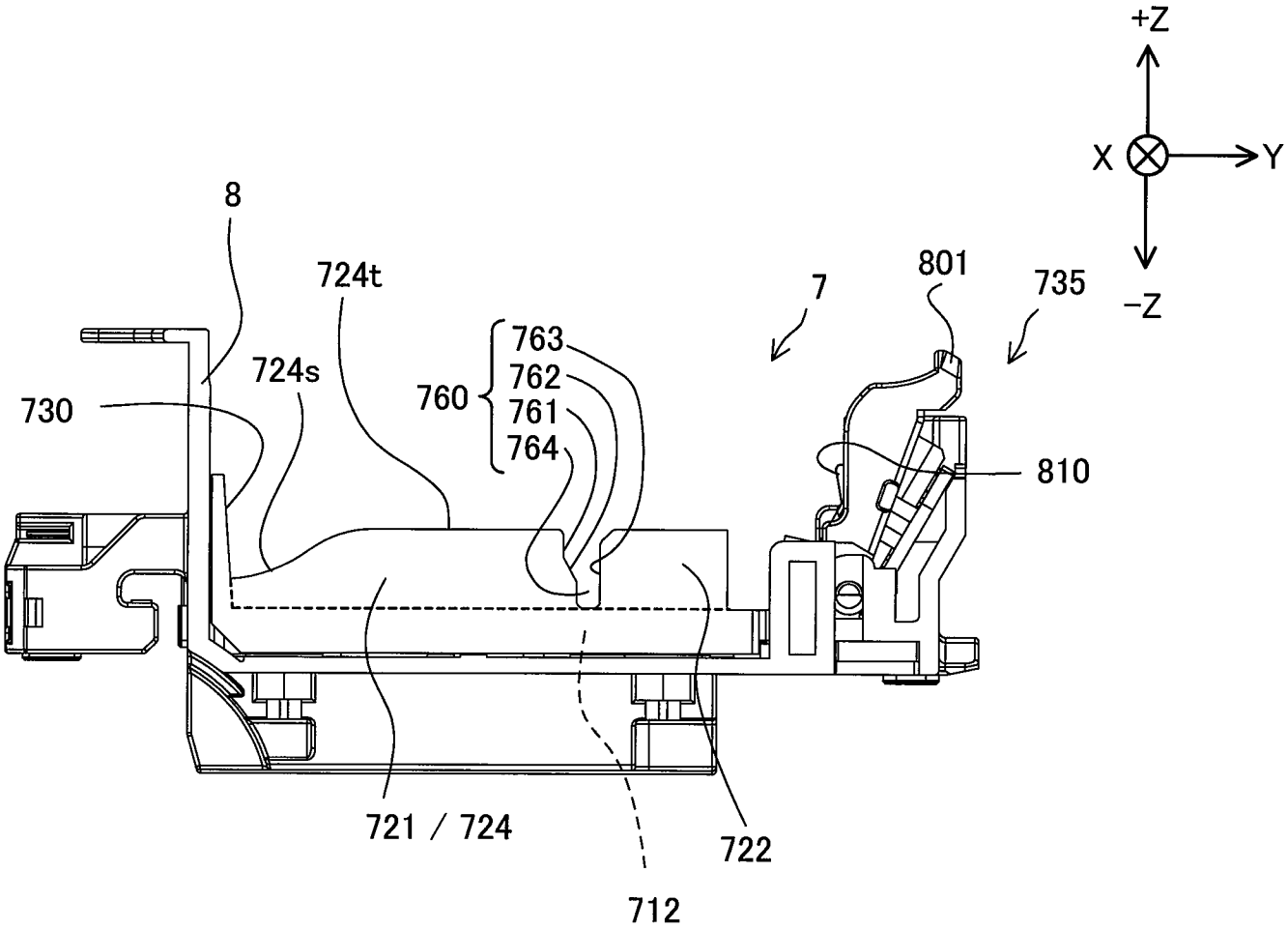
FIG. 6 is a diagram illustrating the wall configuration of the cartridge attachment structure.
Figure 7:
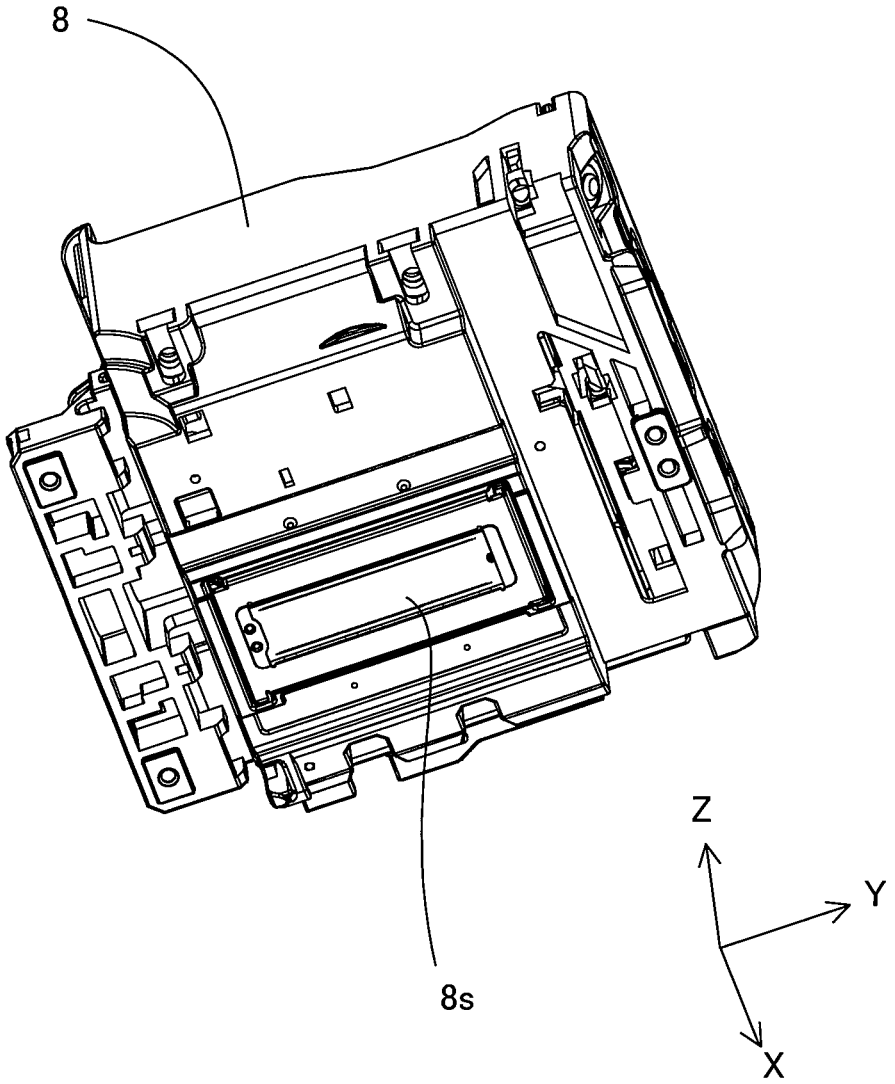
FIG. 7 is a schematic perspective view illustrating the carriage in the non-cartridge attachment state, viewed from the bottom side.
Figure 8:
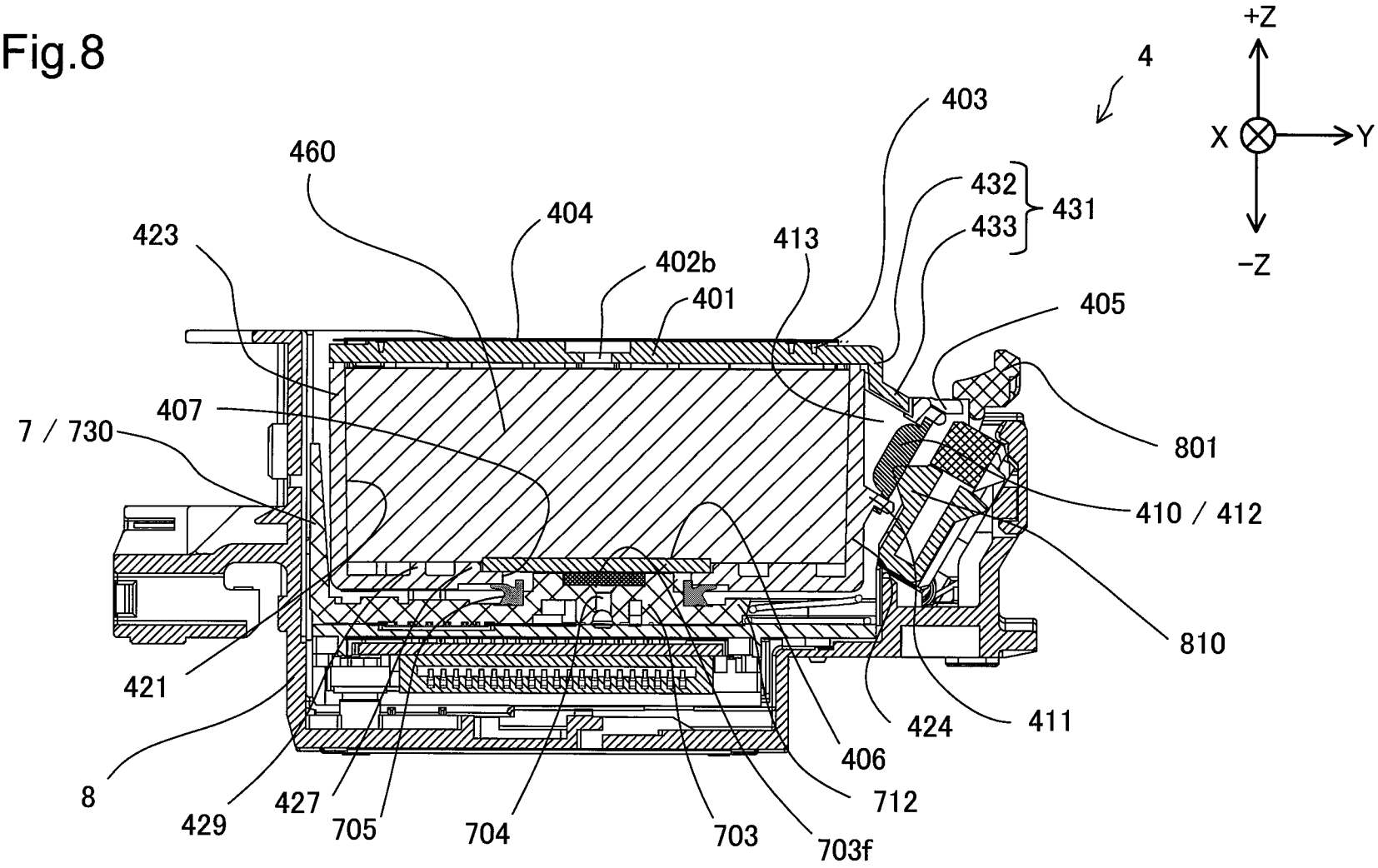
FIG. 8 is a schematic cross sectional view, taken on a line 8-8 in FIG. 3.

FIG. 3 is a perspective view schematically illustrating the appearance of the carriage 8 in the cartridge attachment state and the state after attachment of the cartridge. FIG. 4 is a schematic perspective view illustrating the carriage 8 in the non-cartridge attachment state. FIG. 5 is a schematic exploded perspective view illustrating the cartridge attachment structure 7 in the non-cartridge attachment state, viewed in a different direction from that of FIG. 4. FIG. 6 is a diagram illustrating the wall configuration of the cartridge attachment structure 7. FIG. 7 is a schematic perspective view illustrating the carriage 8 in the non-cartridge attachment state, viewed from the bottom side. FIG. 8 is a schematic cross sectional view, taken on a line 8-8 in FIG. 3. The cartridge attachment structure 7 is mounted on the bottom of the carriage 8 and is omitted from the illustration of FIG. 3.

As shown in FIG. 3, the cartridges 4 and 5 respectively have covers 401 and 501. The cover 401 has through holes 402*a*, 402*b* and 402*c* formed to pass through the cover 401, an air groove 403 arranged in a serpentine shape from the through hole 402*a* to the through hole 402*b* and an air communication hole 434. The cover 501 has through holes 502*a*, 502*b* and 502*c* formed to pass through the cover 502, air grooves 503 arranged in a serpentine shape from the through hole 502*a* to the through hole 502*b* and air communication holes 534. In the manufacturing process of the cartridge 4, the through hole 402*a* is used as an evacuation hole to suck the air from inside of the cartridge 4 and keep the inside of the cartridge 4 in the reduced pressure. After manufacture of the cartridge 4, the through hole 402*a* is used to supply the air to a liquid retaining member 460 described later through the air groove 403, the through hole 402*b* and the air communication hole 434. In the manufacturing process of the cartridge 4, the through hole 402*c* is used as an ink ejection hole through which ink is injected into inside of the cartridge 4. After manufacture of the cartridge 4, the through hole 402*c* is sealed and closed by a seal member 404. The cartridge 5 is configured to contain the three different color inks, yellow, magenta and cyan as described above and accordingly have the through holes 502*a*, 502*b* and 502*c*, the air grooves 503 and the air communication holes 534 at positions corresponding to respective color ink containing parts described later. The cartridges 4 and 5 respectively have seal members 404 and 504 to be joined with the upper surfaces of the covers 401 and 501 and cover the openings of the above through holes and air grooves.

The cartridge 4 and 5 joined with the seal members 404 and 504 are attached to the carriage 8 via the cartridge attachment structure 7 incorporated in the bottom of the carriage 8, as shown in FIG. 4. In this attachment state, the cartridges 4 and 5 are aligned in the moving direction of the carriage 8 (X-axis direction). In the attachment state, an engagement portion 405 described later as an attachment/detaching mechanism included in the cartridge 4 is engaged with a cartridge engagement arm 801 of the carriage 8. The user may apply an external force to the cartridge engagement arm 801 to rotate and displace the cartridge engagement arm 801 and release engagement of the cartridge 4 with the carriage 8. The user can then detach the cartridge 4 from the carriage 8. The cartridge 5 can also be detached from the carriage 8 by the structure and method similar to those described above with respect to the cartridge 4.

As shown in FIG. 4, the carriage 8 has the cartridge attachment structure 7. The cartridge attachment structure 7 includes a liquid introducing part 710*b* for black ink, a liquid introducing part 710*y* for yellow ink, a liquid introducing part 710*m* for magenta ink, a liquid introducing part 710*c* for cyan ink, and cone-shaped coil springs 720. The coil springs 720 are placed corresponding to the cartridges 4 and 5. The coil spring 720 is compressed in the cartridge attachment state and is stretched to press up the cartridge 4 or 5 in the state of releasing the engagement of the cartridge engagement arm 801. An elastic member 705 is a member made of, for example, an elastomer and formed in a ring shape and is mounted on an outer wall section of a liquid introducing base 703.

The respective liquid introducing parts 710 for the respective color inks are provided corresponding to the liquid containing parts of the cartridges 4 and 5 attached to the cartridge attachment structure 7 and have similar structures with some difference in size. The structure of the liquid introducing part 710*b* is described as an example. The liquid introducing part 710*b* includes a liquid introducing base 703, a metal mesh 703*s* and an elastic member 705. The metal mesh 703*s* is provided as a filter made of a metal having corrosion resistance, such as stainless steel and is placed on an upper end of the liquid introducing base 703 to be in surface contact with a supply port-side liquid retaining member 406 of the cartridge 4 described below (FIG. 8). Ink retained in the supply port-side liquid retaining member 406 passes through the metal mesh 703*s* and is supplied to the ejection head 8*s* provided on the bottom surface of the carriage 8 as shown in FIG. 7. The relationship between the respective liquid introducing parts 710 and the cartridges will be described later.

The cartridge 4 has a circuit substrate 410 on a +Y-direction end, as shown in FIG. 8. This circuit substrate 410 is fixed to a substrate mounting structure 411 inclined with respect to a second end wall 424. Fixation of the circuit substrate 410 to the substrate mounting structure 411 and the location of the circuit substrate 410 will be described later. The circuit substrate 410 provided on the cartridge 4 has terminals 412 described later. In the state of attachment of the cartridge 4 to the carriage 8, contact portions of the terminals 412 are electrically in contact with electrodes of an electrode assembly 810 provided on the carriage 8. The cartridge 4 has the engagement portion 405 provided on an end of the substrate mounting structure 411 in the Y-axis direction. The engagement portion 405 is engaged with the cartridge engagement arm 801 of the carriage 8 in the state of attachment of the cartridge 4 to the carriage 8.

FIG. 8 illustrates the state of attachment of the cartridge 4 to the carriage 8. The cartridge 4 has a supply port-side liquid retaining member 406 and a liquid retaining member 460 serving to absorb and retain the liquid. The supply port-side liquid retaining member 406 and the liquid retaining member 460 are arranged to be in contact with each other. The metal mesh 703*s* attached to a ring-shaped end of the liquid introducing base 703 of the liquid introducing part 710*b* provided on the bottom surface of the cartridge attachment structure 7 is in surface contact with the supply port-side liquid retaining member 406. The supply port-side liquid retaining member 406 is lifted up in the +Z direction by the liquid introducing base 703 to press the liquid retaining member 460. This causes the liquid contained in the liquid retaining member 460, i.e., black ink, to be supplied to the ejection head 8*s* of the carriage 8 through the metal mesh 703*s* of the liquid introducing base 703 of the liquid introducing part 710*b* and a suction hole 704. Accordingly, the liquid introducing part 710*b* of the carriage 8 receives a liquid (black ink) introduced from the cartridge 4, and the carriage 8 causes the liquid (black ink) introduced to the liquid introducing part 710*b* to be ejected from the ejection head 8*s*. The cartridge 5 similarly has a circuit substrate 510 and the other relevant components like those of the cartridge 4 and is attached to the carriage 8 as described above.

The cartridge 4 has a liquid supply port 407 covered by the supply port-side liquid retaining member 406. The cartridge attachment structure 7 has the liquid-tight elastic member 705 at the foot of the liquid introducing base 703. This elastic member 705 is in contact with a peripheral concaved area 407*b* (FIG. 12) formed around the periphery of the liquid supply port 407 to seal the liquid supply port 407 and prevent leakage of ink from the liquid supply port 407 in the cartridge attachment state. The liquid supply port 407 is connected with the liquid introducing part 710*b* to supply black ink to the liquid introducing part 710*b* as described later. The structure of attaching the cartridge 4 to the cartridge attachment structure 7 of the carriage 8 will be described later.

The cartridge attachment structure 7 is mounted on the bottom of the carriage 8. As shown in FIGS. 4 to 6, this cartridge attachment structure 7 includes a bottom wall 712, an end wall 730, an inter-cartridge first projection 721, an inter-cartridge second projection 722, a guide projection 723, sidewall-side projections 724, an end wall 730 and an electrode mounting structure 735. In the illustration of FIG. 4, the sidewall-side projection 724 is located as a side of a carriage sidewall 82. The cartridge attachment structure 7 on the carriage 8 also has another sidewall-side projection 724 (not shown) inside of a carriage sidewall 81.

The inter-cartridge first projection 721, the inter-cartridge second projection 722, the guide projection 723 and the sidewall-side projections 724 rise from the bottom wall 712 and are extended in the Y-axis direction to intersect with the bottom wall 712. The end wall 730 rises from the bottom wall 712 and is extended in the X-axis direction to intersect with the bottom wall 712, the inter-cartridge first projection 721, and the guide projection 723 and the sidewall-side projections 724. The electrode mounting structure 735 has the cartridge engagement arm 801 and the electrode assembly 810 described later and is opposed to the end wall 730. The electrode assembly 810 is accordingly built in the electrode mounting structure 735 to be opposed to the end wall 730.

The inter-cartridge first projection 721 is extended from the end wall 730 of the cartridge attachment structure 7 toward the electrode mounting structure 735-side. The inter-cartridge second projection 722 is extended to be continuous with the inter-cartridge first projection 721 across an interval from the inter-cartridge first projection 721. A cartridge engagement wall surface 760 described later is formed in the interval between the inter-cartridge first and second projections 721 and 722. The inter-cartridge first projection 721 and the inter-cartridge second projection 722 also serve as partition walls of the cartridges 4 and 5 aligned in the X-axis direction. First convex ribs 428*a* and 528*a* respectively provided on the cartridges 4 and 5 as described later enter the cartridge engagement wall surface 760 from both sides in the X-axis direction. Accordingly, the inter-cartridge first projection 721 and the inter-cartridge second projection 722 are made to have a larger wall thickness than the wall thicknesses of the guide projection 723 and the sidewall-side projections 724.

The sidewall-side projections 724 are located on both sides of the end wall 730 in the X-axis direction to intersect with the end wall 730 and the bottom wall 712 as described above and are extended in the Y-axis direction from the end wall 730 of the cartridge attachment structure 7 toward the electrode mounting structure 735-side. Each of the sidewall-side projection 724 is divided in the middle of the Y direction to have a cartridge engagement wall surface 760. As shown in FIG. 6, the cartridge engagement wall surface 760 is extended in the Y direction to have a cut on a top surface 724*t* of the sidewall-side projection 724 and includes a first wall surface 761 arranged perpendicular to the bottom wall 712, a second wall surface 762 inclined from the first wall surface 761 toward the bottom wall 712, a third wall surface 763 opposed to the first wall surface 761 and the second wall surface 762 and arranged perpendicular to the bottom wall 712, and a concave 764 on the bottom wall 712-side. The wall surfaces surrounding the concave 764 are perpendicular to the bottom wall 712 and are located closer to the bottom wall 712 than the second wall surface 762. The cartridge engagement wall surfaces 760 are involved in restricting changes in attitude of the cartridges 4 and 5 in the course of attachment of the cartridges 4 and 5 as described in detail later. The top surface 724*t* where the cartridge engagement wall surface 760 is formed is gradually tapered to have an inclined top surface 724*s* having the gradually decreasing height from the bottom wall 712 on the end wall 730-side.

The guide projection 723 is extended from the end wall 730 toward the liquid introducing part 710*y* to go between the liquid introducing part 710*m* and the liquid introducing part 710*c*. In other words, this guide projection 723 is formed between the liquid introducing part 710*m* and the liquid introducing part 710*c* adjacent to each other in the X-axis direction to be located between the liquid introducing part 710*y* and a part between the liquid introducing part 710*m* and the liquid introducing part 710*c*. The cartridge 4 is placed in a mounting area between the sidewall-side projection 724 near to the carriage sidewall 81, and the inter-cartridge first projection 721 and is attached to the cartridge attachment structure 7 of the carriage 8. The cartridge 5 is placed in a mounting area between the inter-cartridge first projection 721 and the sidewall-side projection 724 near to the cartridge sidewall 82 and is attached to the cartridge attachment structure 7 of the carriage 8. The guide projection 723 is placed in a first groove 580 (FIG. 17) of the attached cartridge 5 described later.

The cartridge attachment structure 7 has cartridge first engagement protrusions 741 and cartridge second engagement protrusions 742. The cartridge first engagement protrusions 741 are protruded from the inter-cartridge first projection 721 and the sidewall-side projections 724 and are located on the end wall 730-side to face each other in the mounting area of the cartridge 4 or the cartridge 5 described above. Due to the perspective direction, the cartridge first engagement protrusion 741 formed on the sidewall-side projection 724 in the mounting area of the cartridge 4 and arranged to face the cartridge first engagement protrusion 741 formed on the inter-cartridge first projection 721, as well as the cartridge first engagement protrusion 741 formed on the inter-cartridge first projection 721 and arranged to face the cartridge first engagement protrusion 741 formed on the sidewall-side projection 724 in the mounting area of the cartridge 5 are omitted from the illustration of FIGS. 4 and 5. The cartridge second engagement protrusions 742 are located away from the Y-direction ends of the sidewall-side projections 724 and the inter-cartridge first projection 721 and are provided on a mounting base of the electrode assembly 810 provided on the carriage 8. The cartridge second engagement protrusions 742 are located on the electrode assembly 810-side to face each other in the mounting area of the cartridge 4 or the cartridge 5 described above. The cartridge first engagement protrusions 741 and the cartridge second engagement protrusions 742 have the positioning function of the attached cartridges in the X-axis direction. The cartridge attachment structure 7 also has engagement holes 750 formed in the end wall 730. The two engagement holes 750 are provided for each of the cartridge 4 and the cartridge 5. In the course of attachment of the cartridges 4 and 5, engagement projections 423*t* and 523*t* described later are fit in these engagement holes 750. Attachment and positioning of the cartridges 4 and 5 and the relationship between the guide projection 723 and the cartridge 5 will be described later.

A-3. Structure of Cartridge 4

Figure 9:
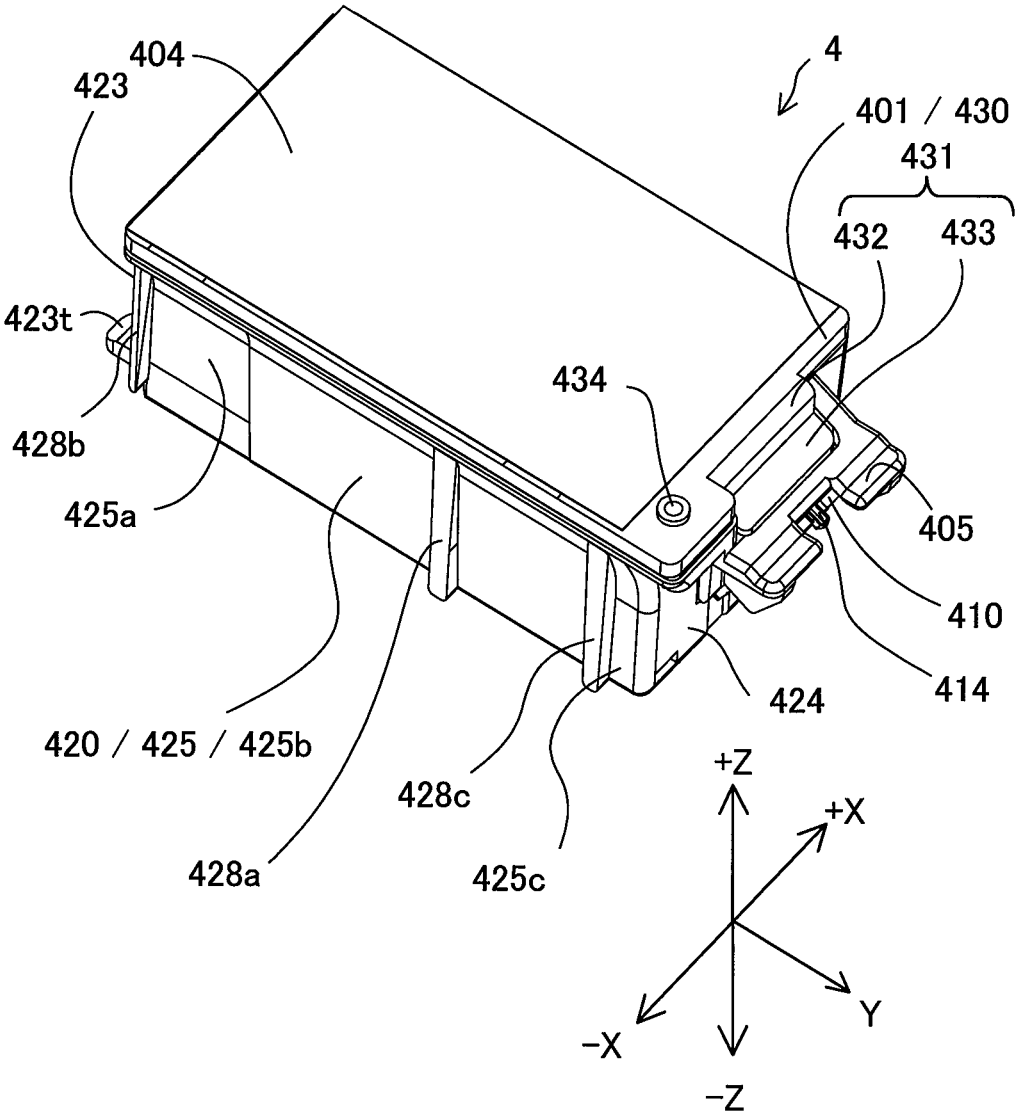
FIG. 9 is an appearance perspective view illustrating a cartridge.
Figure 10:
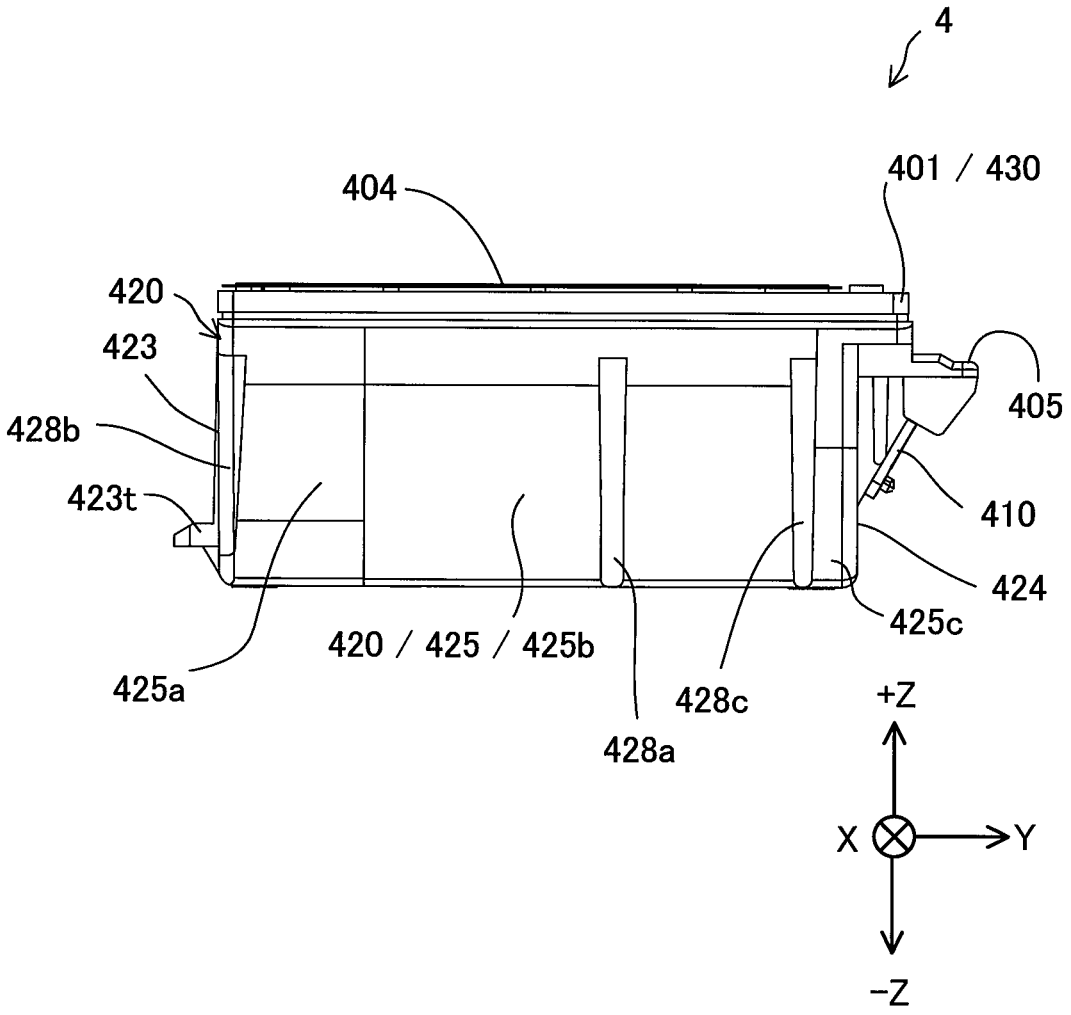
FIG. 10 is a side view illustrating the cartridge of FIG. 9 in an X-axis direction.
Figure 11:
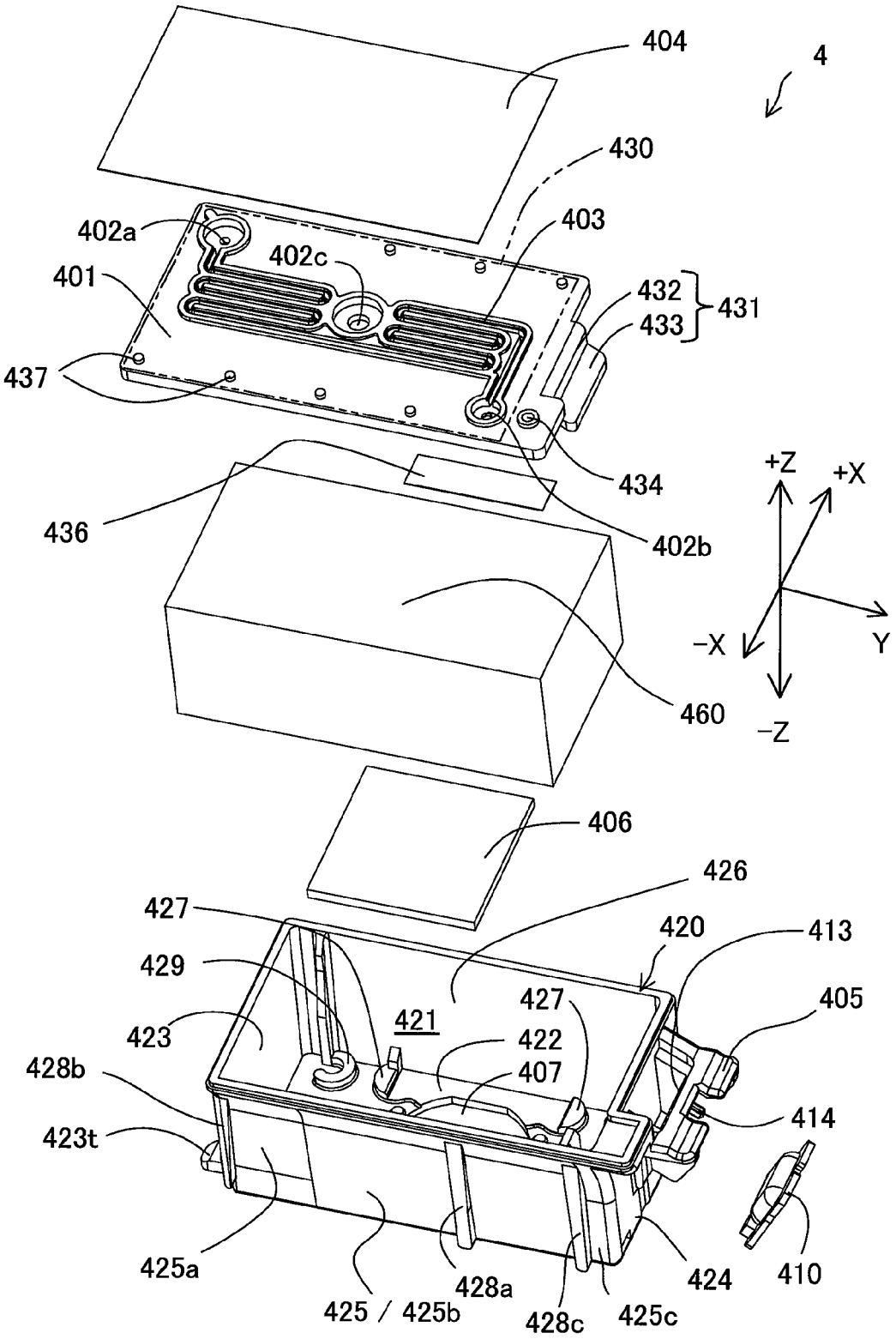
FIG. 11 is an exploded perspective view illustrating the cartridge of FIG. 9.
Figure 12:
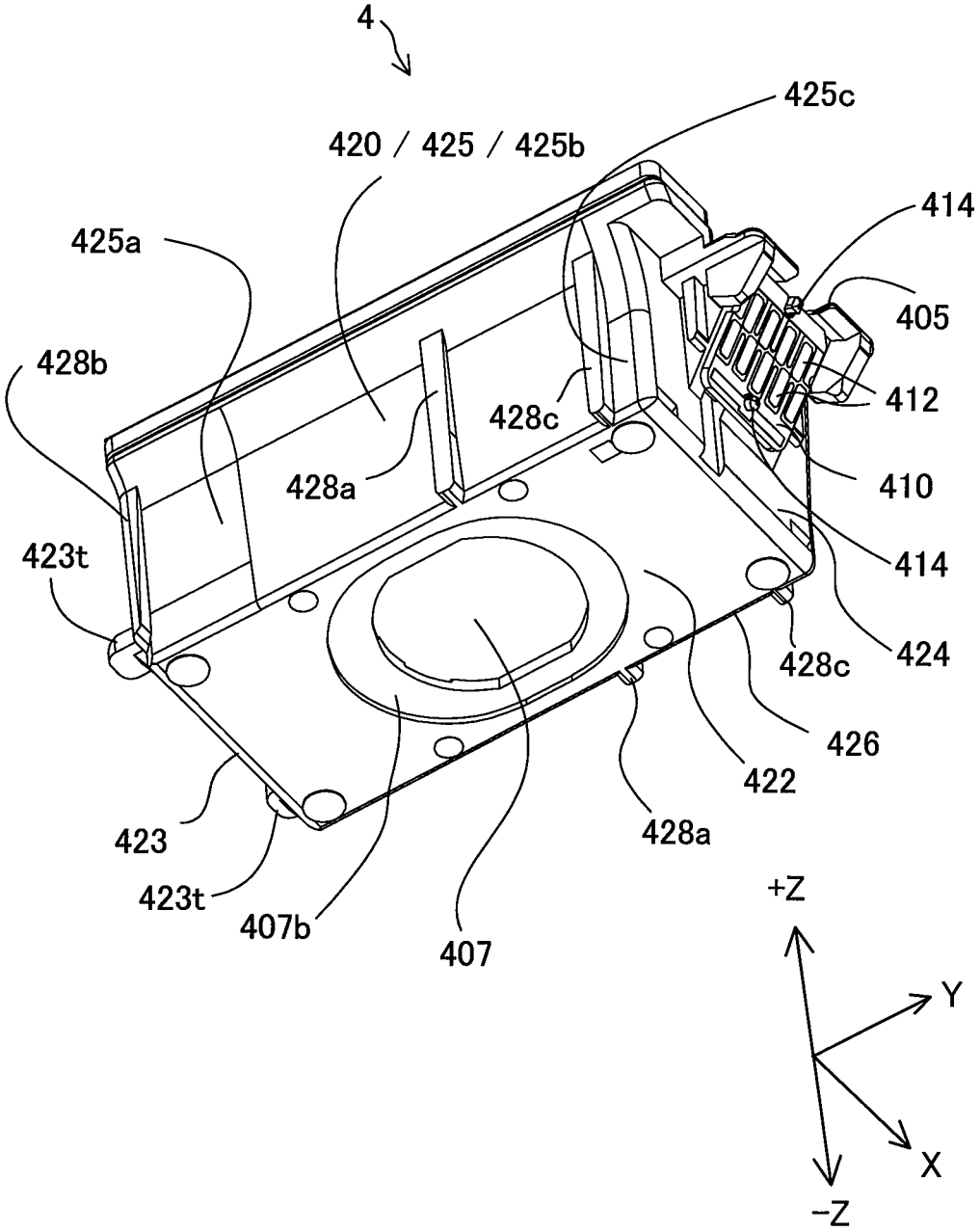
FIG. 12 is an appearance perspective view illustrating the cartridge of FIG. 9 viewed from the bottom side.
Figure 13:
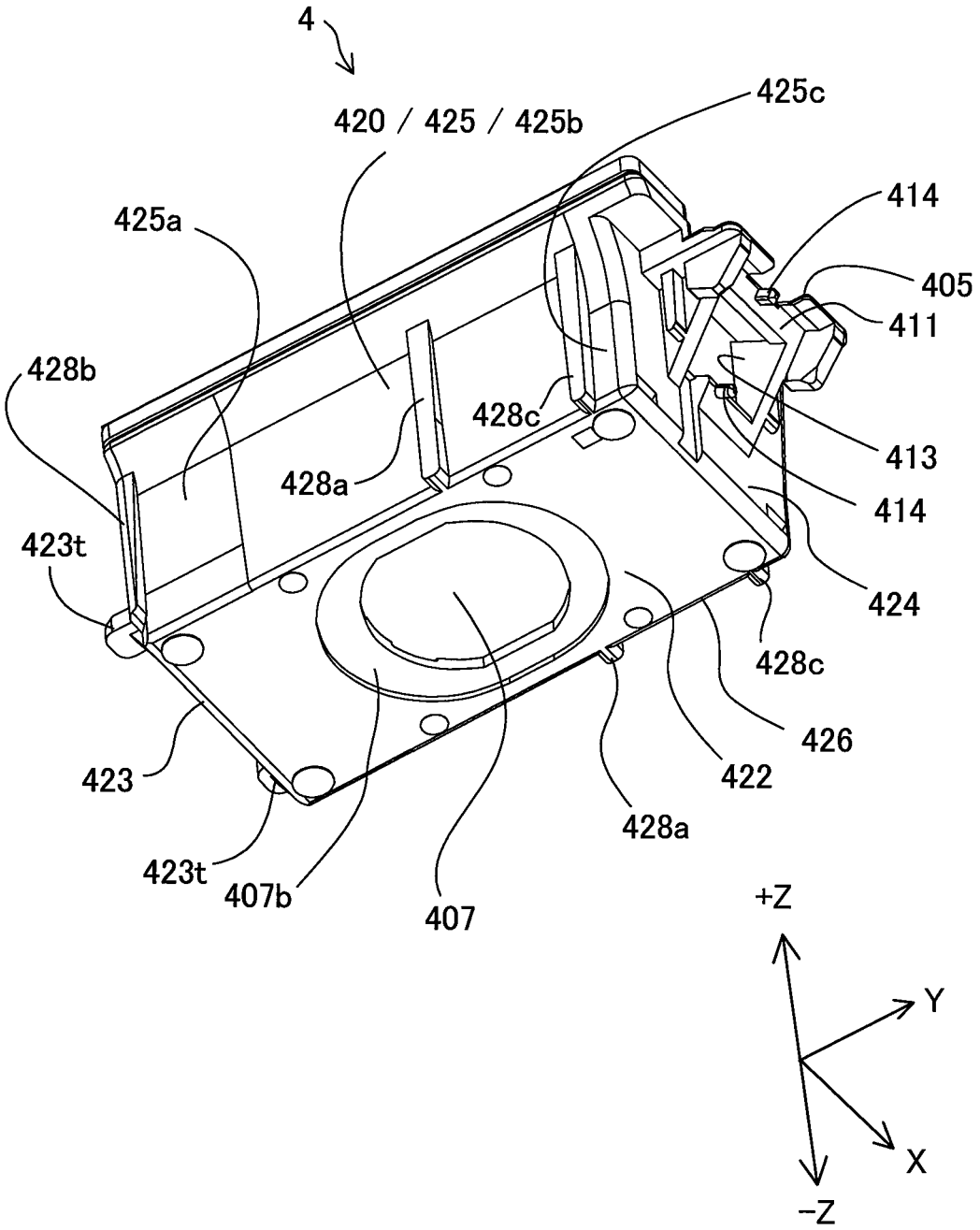
FIG. 13 is an appearance perspective view illustrating the cartridge of FIG. 9 without a circuit substrate viewed from the bottom side.

FIG. 9 is an appearance perspective view illustrating the cartridge 4. FIG. 10 is a side view illustrating the cartridge 4 in the X-axis direction. FIG. 11 is an exploded perspective view illustrating the cartridge 4. FIG. 12 is an appearance perspective view illustrating the cartridge 4 viewed from the bottom side. FIG. 13 is an appearance perspective view illustrating the cartridge 4 without the circuit substrate 410 viewed from the bottom side. As illustrated, the cartridge 4 has a casing 420, the cover 401 and the circuit substrate 410. The cover 401 is fixed to the casing 420 to cover a recess 421 of the casing 420 (FIG. 11). The cartridge 4 also has the supply port-side liquid retaining member 406, the liquid retaining member 460, a cover backside seal member 436 and the seal member 404. The casing 420 and the cover 401 are molded products of a synthetic resin such as polyethylene or polypropylene and are formed by any adequate molding technique such as injection molding.

As shown in FIGS. 9 to 13, the casing 420 includes a bottom wall 422, a first end wall 423, a second end wall 424, a first side wall 425 and a second side wall 426. In the attachment attitude of the cartridge 4 attached to the cartridge attachment structure 7 of the carriage 8 shown in FIGS. 3 and 8 (hereinafter referred to as cartridge attachment attitude), the bottom wall 422 faces the bottom wall 712. In this cartridge attachment attitude, the first side wall 425 faces the sidewall-side projection 724 (FIG. 5), and the second side wall 426 faces the inter-cartridge first projection 721 and the inter-cartridge second projection 722. In the cartridge attachment attitude, the first end wall 423 faces the end wall 730.

The casing 420 has first convex ribs 428*a*, second convex ribs 428*b* and third convex ribs 428*c* on the first side wall 425 and the second side wall 426. These first to third convex ribs 428*a* to 428*c* are extended in the −Z direction from the opening periphery of the casing 420 toward the bottom wall 422-side. The first convex ribs 428*a* and the third convex ribs 428*c* reach the bottom face of the bottom wall 422. The second convex ribs 428*b* are formed to be shorter than the third convex ribs 428*c* in the −Z direction. This difference corresponds to the difference in height between the lowermost surface of the inclined top surface 724*s* and the upper surface of the bottom wall 712 shown in FIG. 6. Accordingly, in the attachment attitude of the cartridge 4 attached to the cartridge attachment structure 7, the lower edges of the third convex ribs 428*c* come into contact with the upper surface of the bottom wall 712, whereas the lower edges of the second convex ribs 428*b* come into contact with the lowermost surface of the inclined top surface 724*s*. In the case that the second end wall 424 is rotated toward the first end wall 423 in the course of attachment of the cartridge 4, the third convex ribs 428*c* come into contact with the lowermost surface of the inclined top surface 724*s*. This prevents the bottom wall 422 of the cartridge 4 from reaching the bottom wall 712 of the cartridge attachment structure 7. This configuration accordingly prevents wrong attachment of the cartridge 4. The distance from the bottom wall 422 to the first convex ribs 428*a* may be longer than or shorter than the distance from the bottom wall 422 to the second convex ribs 428*b*.

The first convex ribs 428*a* are protrusions protruded outward from the first side wall 425 and from the second side wall 426. The first convex rib 428*a* on the first side wall 425 comes into contact with the third wall surface 763 of the cartridge engagement wall surface 760, which is extended in the direction intersecting with the bottom wall 422 and the first side wall 425 in the cartridge attachment attitude, in the sidewall-side projection 724 (FIGS. 5 and 6). The first convex rib 428*a* on the second side wall 426 comes into contact with the third wall surface 763 of the cartridge engagement wall surface 760, which is extended in the direction intersecting with the bottom wall 422 and the first side wall 425 in the cartridge attachment attitude, in the continuous projection of the inter-cartridge first projection 721 and the inter-cartridge second projection 722 (FIGS. 5 and 6). The state that the convex ribs comes into contact in the cartridge attachment attitude and the relationship of the convex ribs to the cartridge engagement wall surface 760 will be described later.

The second convex rib 428*b* on the first side wall 425 is a protrusion protruded outward from the first side wall 425. In the plan view of the cartridge 4 in a direction toward the first side wall 425, the second convex rib 428*b* is located closer to the first end wall 423 than the first convex rib 428*a*. Similarly the second convex rib 428*b* on the second side wall 426 is a protrusion protruded outward from the second side wall 426 and is located closer to the first end wall 423 than the first convex rib 428*a* in the plan view of the cartridge 4 in a direction toward the second side wall 426. According to this embodiment, the second convex ribs 428*b* are provided at the corner between the first end wall 423 and the first side wall 425 and at the corner between the first end wall 423 and the second side wall 426, such that the second convex ribs 428*b* are flush with the outer wall surface of the first end wall 423.

The third convex rib 428*c* on the first side wall 425 is a protrusion protruded outward from the first side wall 425. In the plan view of the cartridge 4 in the direction toward the first side wall 425, the third convex rib 428*c* is located on the opposite side of the second convex rib 428*b* across the first convex rib 428*a*. Similarly the third convex rib 428*c* on the second side wall 426 is a protrusion protruded outward from the second side wall 426 and is located on the opposite side of the second convex rib 428*b* across the first convex rib 428*a* in the plan view of the cartridge 4 in the direction toward the second side wall 426. Providing the first convex rib 428*a* on the side of the third convex rib 428*c* causes the distance from the first convex rib 428*a* to the second convex rib 428*b* to be greater than the distance from the first convex rib 428*a* to the third convex rib 428*c* in the plan view of the cartridge 4 in the direction toward the first side wall 425 or toward the second side wall 426.

The bottom wall 422 forms the bottom surface of the casing 420 and has the liquid supply port 407 formed at the center thereof. The bottom wall 422 is opposed to the cover 401 (more specifically a cover member 430 described below). The first end wall 423 rises from the bottom wall 422 to be joined with and intersect with the cover member 430 of the cover 401. The second end wall 424 rises from the bottom wall 422 to be joined with and intersect with the cover member 430 of the cover 401 and is opposed to the first end wall 423. The first side wall 425 rises from the bottom wall 422 between one edge (−X-direction edge in FIG. 11) of the first end wall 423 and one edge (−X-direction edge in FIG. 11) of the second end wall 424 to be joined with and intersect with the cover member 430 of the cover 401. The second side wall 426 rises from the bottom wall 422 between the other edge (+X-direction edge in FIG. 11) of the first end wall 423 and the other edge (+X-direction edge in FIG. 11) of the second end wall 424 to be joined with and intersect with the cover member 430 of the cover 401 and is opposed to the first side wall 425.

This wall configuration may also be expressed as follows. The casing 420 includes the bottom wall 422 located on the bottom in the state that the cartridge 4 is attached to the carriage 8, the first side wall 425 arranged to intersect with the bottom wall 422, the first end wall 423 arranged to intersect with the bottom wall 422 and the first side wall 425, the second side wall 426 arranged to intersect with the bottom wall 422 and the first end wall 423 and opposed to the first side wall 425, the second end wall 424 arranged to intersect with the bottom wall 422, the first side wall 425 and the second side wall 426 and opposed to the first end wall 423, and the cover 401 arranged to intersect with the first side wall 425, the second side wall 426, the first end wall 423 and the second end wall 424 and opposed to the bottom wall 422. The liquid retaining member 460 and the supply port-side liquid retaining member 406 are placed in the recess 421 surrounded by these walls.

As shown in FIG. 12, the circuit substrate 410 has a plurality of terminals 412 on the substrate surface and is located on the second end wall 424 of the casing 420. The substrate mounting structure 411 is formed on the second end wall 424 as shown in FIG. 13. The substrate mounting structure 411 is arranged to be inclined with respect to the second end wall 424. The circuit substrate 410 has the rear surface fixed to the substrate mounting structure 411 and is inclined with respect to the second end wall 424. As shown in FIG. 12, the terminals 412 are arrayed zigzag in two lines on the circuit substrate 410. When the cartridge 4 is attached to the carriage 8 as described above, the contact portions of the respective terminals 412 are electrically connected with respective electrodes of the electrode assembly 810 provided on the carriage 8 as shown in FIG. 8. The shape and the arrangement of the terminals 412 are not limited to those of FIG. 12. The terminals 412 may have any configuration which enables their contact portions to be electrically connectable with the electrode assembly 810.

As shown in FIG. 13, the substrate mounting structure 411 has an opening 413 on the outer wall surface side of the second end wall 424. The opening 413 is extended in the Z-axis direction along the outer wall surface of the second end wall 424 from an upper edge side toward a lower edge side of the second end wall 424 (FIG. 11) and is open on the upper edge side and the lower edge side of the second end wall 424. In the state that the cover 401 is fixed to the casing 420, the opening 413 is closed on the upper edge side of the second end wall 424 by an outward extension member 431 of the cover 401 described later as shown in FIG. 9. Projections 414 protruded from the substrate mounting structure 411 are used for fixation of the circuit substrate 410 to the substrate mounting structure 411. The projections 414 are thermally caulked in the state that the projections 414 are extended from the circuit substrate 410 as shown in FIG. 13. This fixes the circuit substrate 410 to the substrate mounting structure 411.

As shown in FIG. 11, the cover 401 has the cover member 430 and the outward extension member 431. The cover member 430 is in a flat plate-like shape and is arranged to cover the recess 421 of the casing 420. The outward extension member 431 is extended outward from the cover member 430 on the second end wall 424-side where the circuit substrate 410 with the terminals 412 is located, and includes a bent extension section 432 and an inclined extension section 433. The bent extension section 432 is bent at approximately 90 degrees to the cover member 430 and is extended to be protruded along a direction from the cover 401 toward the casing 420 (−Z direction in FIG. 11). The inclined extension section 433 continuous with the bent extension section 432 is extended to a location to hang over the terminals 412 of the circuit substrate 410 in the plan view of the cover 401 in the direction from the cover 401 toward the casing 420 (−Z direction in FIG. 11). In the state that the cover 401 is fixed to the casing 420, the outward extension member 431 is hung over the opening 413 to close the opening 413 on the upper edge side of the second end wall 424 as shown in FIG. 13. In the state that the cover 401 is fixed to the casing 420, the inclined extension section 433 of the outward extension member 431 is engaged with the engagement portion 405 as shown in FIG. 9. The inclined extension section 433 of the outward extension member 431 is protruded to the outer side of at least the terminals 412 in the lower line of the circuit substrate 410 in a first direction from the first end wall 423 toward the second end wall 424 (+Y direction in FIGS. 8 and 11). In one modification, the inclined extension section 433 may be extended longer than the illustrated state to be protruded to the outer side of all the terminals 412 of the circuit substrate 410.

The cover 401 has the air communication hole 434 and a plurality of seal member receiving elements 437, in addition to the through holes 4021, 402*b* and 402*c* and the air groove 403 described above. The seal member receiving elements 437 are protruded from the upper surface of the cover 401 to substantially the same height as the height of the circumferential walls of the through holes 402*a*, 402*b* and 402*c* and the circumferential wall of the air groove 403 and serve as joint seat elements of the seal member 404.

The air communication hole 434 is provided in a cover member outer periphery formed by extending part of the cover member 430 in the Y-axis direction and is formed to pass through the cover 401 on its cover member outer periphery. The air communication hole 434 is connected with the through hole 402*b* by an air groove (not shown) on the rear surface of the cover 401. This air groove, the cover backside opening of the air communication hole 434 and the cover backside opening of the through hole 402*b* are sealed by the cover backside seal member 436. The recess 421 of the casing 420 closed by the cover 401 is accordingly open to the air through the air communication hole 434 via the through hole 402*a*, the air groove 403 and the through hole 402*b*. This arrangement of open to the air is described in relation to the liquid retaining member 460.

The liquid retaining member 460 is placed in the recess 421 of the casing 420. The bottom wall 422 of the casing 420 has step-like semicircular projections 427 formed on the periphery of the liquid supply port 407, and the supply port-side liquid retaining member 406 is placed on the steps of the semicircular projections 427 (FIG. 8). The liquid supply port 407 is accordingly covered by the supply port-side liquid retaining member 406. The bottom wall 422 also has arc-shaped projections 429 in an open arc shape in the plan view provided in the neighborhood of the respective corners. The liquid retaining member 460 is supported by the upper surfaces of the arc-shaped projections 429 at the respective corners and the semicircular projections 427 and is placed in the casing 420. In the state that the liquid retaining member 460 is placed in this manner, the cover 401 joined with the cover backside seal member 436 and the seal member 404 is welded and fixed to the casing 420 to complete the cartridge 4 shown in FIGS. 8 and 9.

Both the supply port-side liquid retaining member 406 and the liquid retaining member 460 may be made of a porous resin material. The porous resin material herein is not specifically limited but may be any porous resin material having the capacity of retaining the liquid, for example, a foamed material such as polyurethane foam or a fibrous material of bundled polypropylene fibers. The supply port-side liquid retaining member 406 and the liquid retaining member 460 have different characteristics of retaining the liquid. The supply port-side liquid retaining member 406 is made to have a higher pore density or density of pores than the liquid retaining member 460. According to the magnitude relationship of the pore density, the supply port-side liquid retaining member 406 has greater capillary force than the capillary force of the liquid retaining member 460.

This magnitude relationship of the capillarity force between the supply port-side liquid retaining member 406 and the liquid retaining member 460 causes ink contained in the liquid retaining member 460 to flow in the sequence described below. Ink flows from a member having smaller capillary force to a member having greater capillary force. As shown in FIG. 8, when ink contained in the supply port-side liquid retaining member 406 is sucked via the liquid introducing base 703 to be consumed, ink contained in the liquid retaining member 460 laid on the upper surface of the supply port-side liquid retaining member 406 moves to the supply port-side liquid retaining member 406. The driving force of such ink migration is mainly given by the capillary force of the supply port-side liquid retaining member 406. Such ink migration has no difficulty, due to the air communication through the through hole 402*a* formed corresponding to the location where the liquid retaining member 460 is placed, the air groove 403 continuous with the through hole 402*a* and the air communication hole 434.

Placing the supply port-side liquid retaining member 406 and the liquid retaining member 460 having different characteristics in the recess 421 of the casing 420 as described above, in combination with using the metal mesh 703*s* having greater capillary force than the capillarity force of the supply port-side liquid retaining member 406 for the liquid introducing base 703, allows for efficient consumption of ink contained in the liquid retaining member 460. In other words, this reduces the remaining quantity of unused ink in the liquid retaining member 460.

As long as the capillary forces of the supply port-side liquid retaining member 406 and the liquid retaining member 460 are arranged to decrease with an increase in distance from the liquid introducing base 703, the magnitude relationship of the pore density between the respective liquid retaining members 406 and 460 is not limited to the configuration of this embodiment. For example, when the supply port-side liquid retaining member 406 and the liquid retaining member 460 have identical pore densities, the respective liquid retaining members 406 and 460 may be subjected to water repellent treatment or hydrophobic treatment to have the magnitude relationship of the capillary force described above.

As shown in FIGS. 9 to 13, the cartridge 4 also has a pair of engagement projections 423*t* at the lower edge of the outer wall surface of the first end wall 423. In the course of attachment of the cartridge 4 to the cartridge attachment structure 7, the engagement projections 423*t* enter the end wall 730 of the cartridge attachment structure 7 (FIG. 4). The first end wall 423 is thus engageable with the end wall 730 of the cartridge attachment structure 7 by insertion of the engagement projections 423*t* into the end wall 730. This configuration is involved in restricting the change in attitude of the cartridge 4 as described later in the course of attachment of the cartridge 4.

The following describes the casing configuration involved in positioning of the carriage 8 or more specifically the cartridge attachment structure 7 mounted on the carriage 8. As illustrated in FIGS. 9 to 13, the first side wall 425 of the casing 420 includes a first side wall part 425*a*, a second side wall part 425*b* and a third side wall part 425*c* sequentially aligned from the first end wall 423-side in the first direction from the first end wall 423 toward the second end wall 424 (Y direction). The first side wall part 425*a* occupies about one third of the width of the first side wall 425 in the first direction, and the third side wall part 425*c* occupies the area between the first convex rib 428*a* and the second end wall 424. The second side wall part 425*b* occupies the remaining area. The first side wall part 425*a* has the outer wall surface on the bottom wall 422-side arranged to be substantially perpendicular to the bottom wall 422.

As shown in FIGS. 9 to 13, the second side wall part 425*b* is extended from the bottom wall 422 to be inclined with respect to the bottom wall 422. The third side wall part 25*c* has the outer wall surface on the bottom wall 422-side arranged to be substantially perpendicular to the bottom wall 422. Similarly the second side wall 426 includes a first side wall part 426*a*, a second side wall part 426*b* and a third side wall part 426*c*. The perpendicular outer wall surfaces of the first side wall part 426*a* and the third side wall part 426*c* of the second side wall 426 and the perpendicular outer wall surfaces of the first side wall part 425*a* and the third side wall part 425*c* of the first side wall 425 are positioned back to back across the bottom wall 422.

A-4. Structure of Cartridge 5

Figure 14:
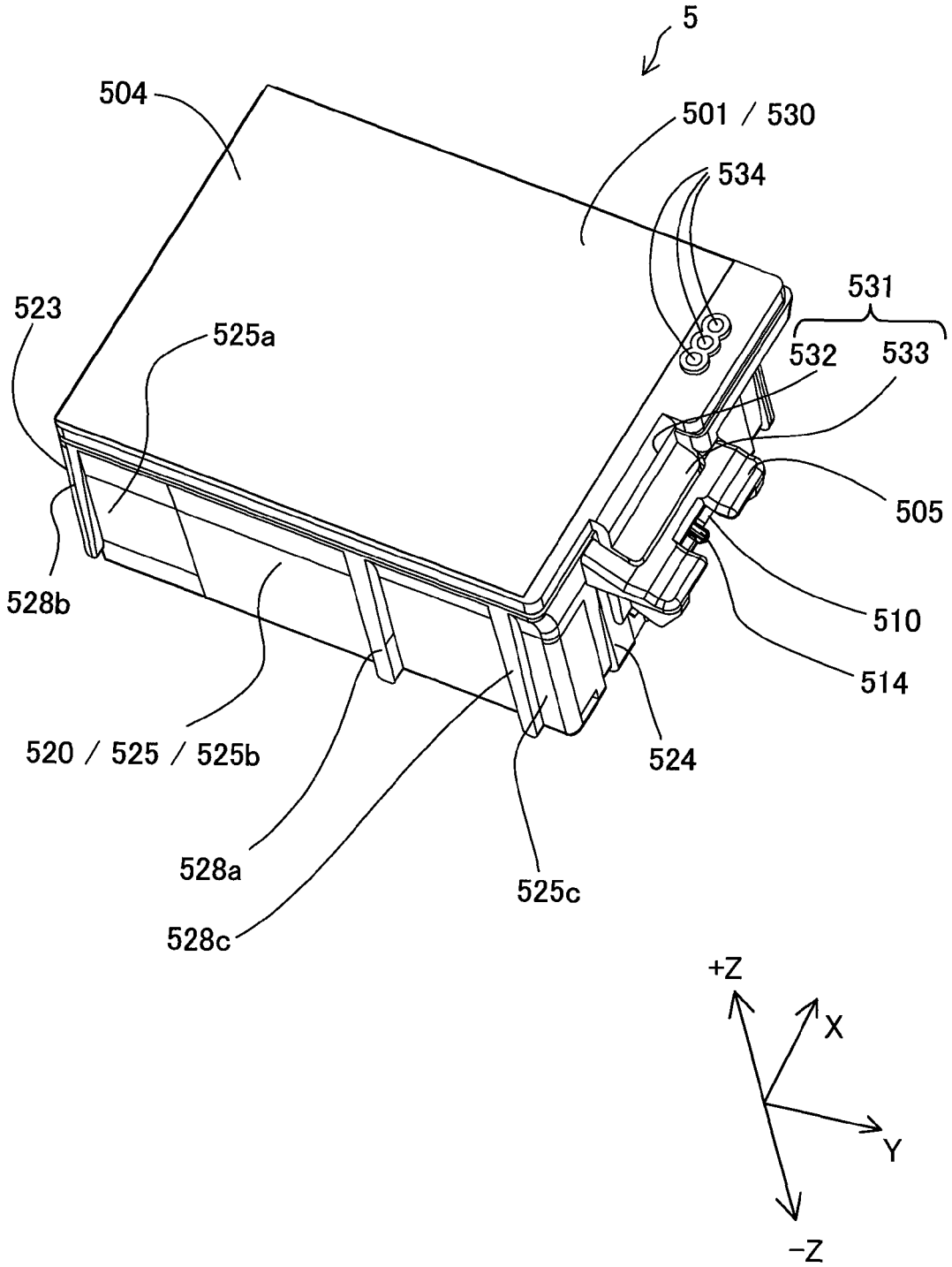
FIG. 14 is an appearance perspective view illustrating another cartridge.
Figure 15:
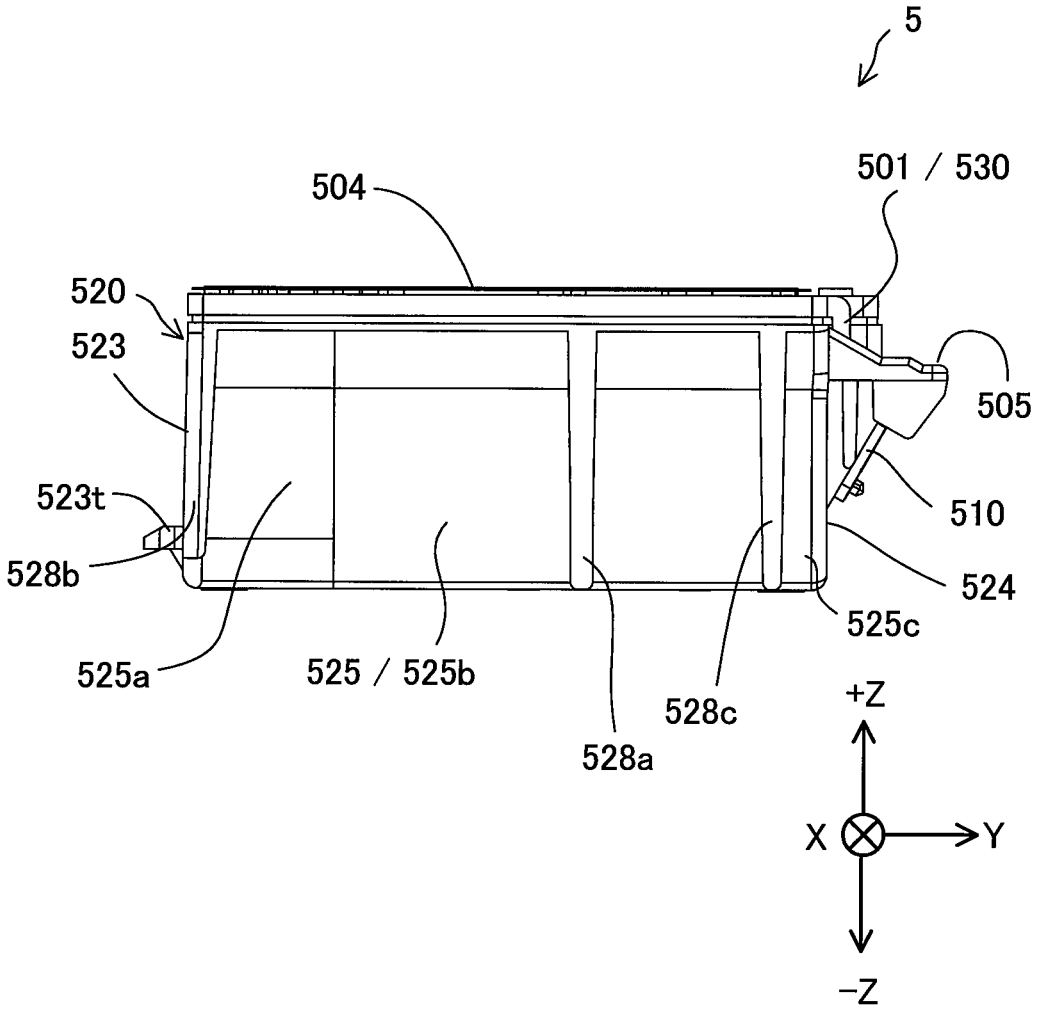
FIG. 15 is a side view illustrating the cartridge of FIG. 14 in the X-axis direction.
Figure 16:
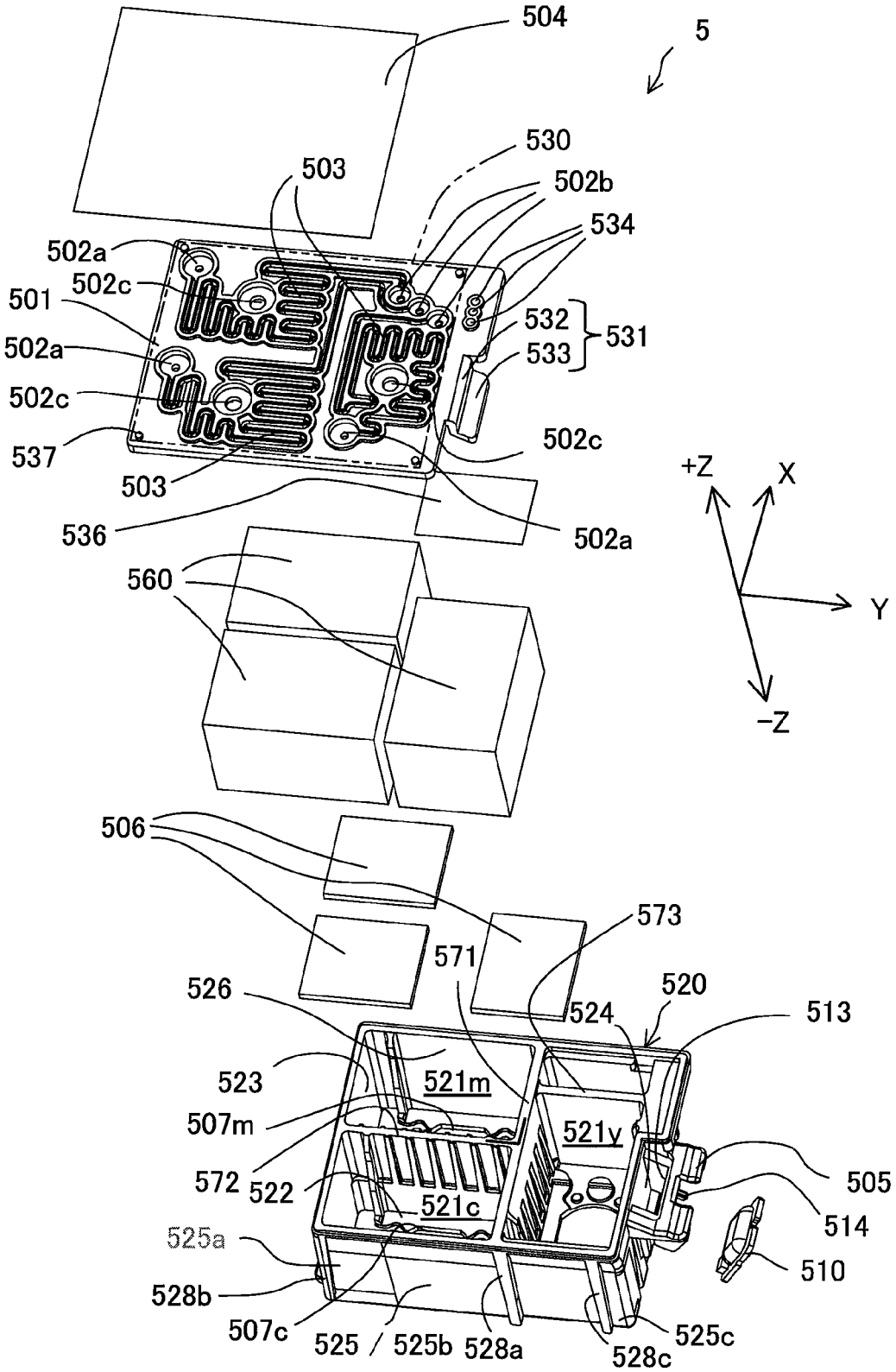
FIG. 16 is an exploded perspective view illustrating the cartridge of FIG. 14.
Figure 17:
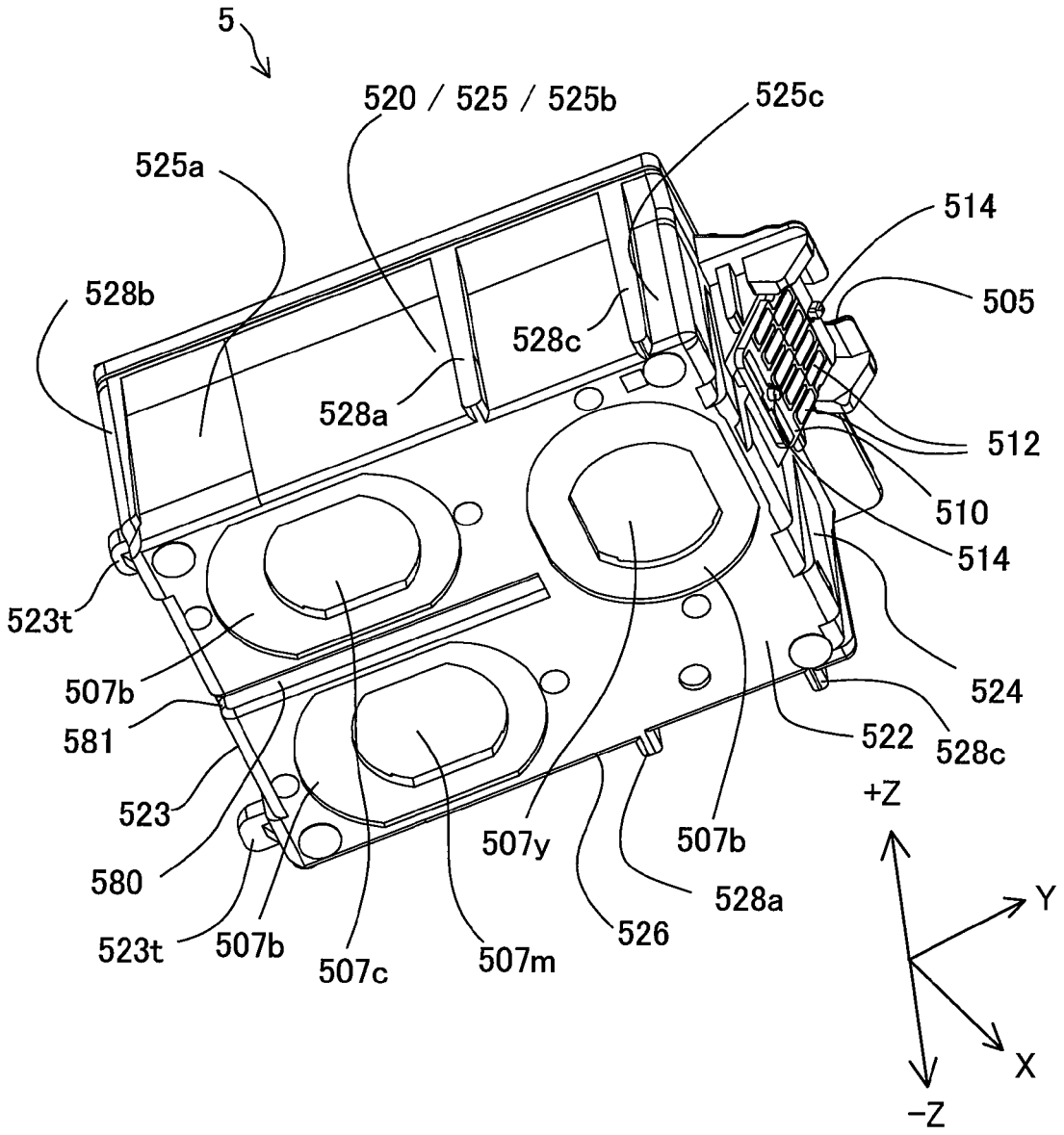
FIG. 17 is an appearance perspective view illustrating the cartridge of FIG. 14 viewed from the bottom side.
Figure 18:
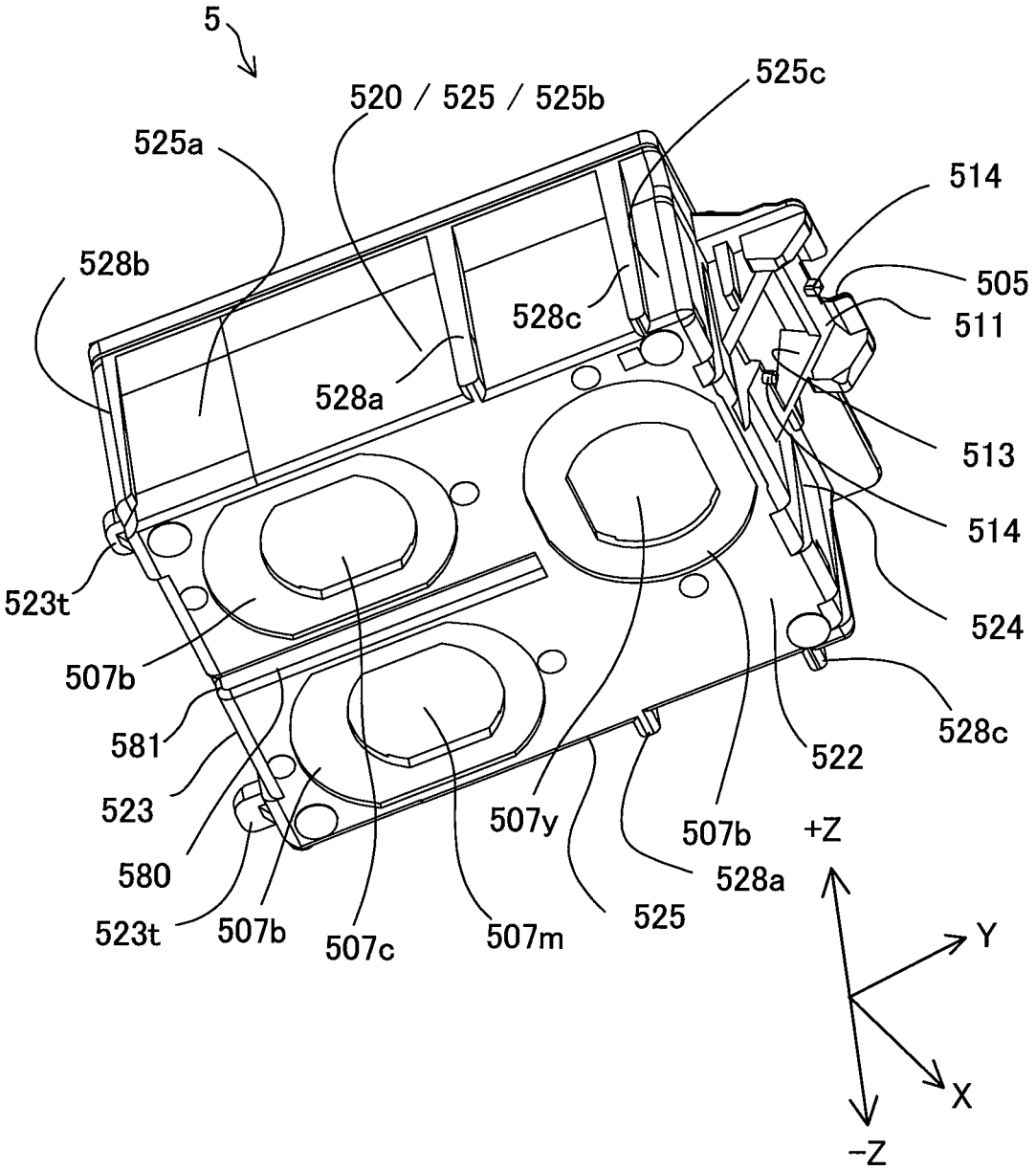
FIG. 18 is an appearance perspective view illustrating the cartridge of FIG. 14 without a circuit substrate viewed from the bottom side.

The cartridge 5 has the different structure from that of the cartridge 4 by containing three different color inks, yellow, magenta and cyan. In the description of the structure of the cartridge 5, the like components to those of the cartridge 4 are expressed by like numerical symbols with the digit at a highest place changed to 5 and are only briefly explained. FIG. 14 is an appearance perspective view illustrating the cartridge 5. FIG. 15 is a side view illustrating the cartridge 5 in the X-axis direction. FIG. 16 is an exploded perspective view illustrating the cartridge 5. FIG. 17 is an appearance perspective view illustrating the cartridge 5 viewed from the bottom side. FIG. 18 is an appearance perspective view illustrating the cartridge 5 without the circuit substrate 510 viewed from the bottom side.

As illustrated, the cartridge 5 has a casing 520, the cover 501 and the circuit substrate 510. The cover 501 is fixed to the casing 520 to cover three recesses 521*m*, 521*c* and 521*y* of the casing 520 (FIG. 16). The casing 520 has a partition wall 571 located between a first side wall 525 and a second side wall 526, a partition wall 572 located between the partition wall 571 and a second end wall 523 and a partition wall 573 located between the partition wall 571 and a first end wall 524. These partition walls 571, 572 and 573 form the recesses 521*m*, 521*c* and 521*y* corresponding to the respective color inks, magenta, cyan and yellow. The cartridge 5 has supply port-side liquid retaining members 506 placed in respective areas defined by semicircular projections 527 provided on the respective peripheries of ink supply ports 507*m*, 507*y* and 507*c* formed in a bottom wall 522 in the respective recesses 521*m*, 521*c* and 521*y*, and also has liquid retaining members 560 placed on the supply port-side liquid retaining members 506.

The partition walls 571, 572 and 573 and the recesses 521*m* 521*c* and 521*y* have the following positional relationship in the state that the cover 501 is joined with the casing 520. The partition wall 571 is located to intersect with the bottom wall 522, the cover 501, the first side wall 525 and the second side wall 526 and to be opposed to the first end wall 523 and the second end wall 524. The partition wall 572 is located to intersect with the bottom wall 522, the cover 501, the first end wall 523 and the partition wall 571 and to be opposed to the first side wall 525 and the second side wall 526. The recess 521*m* communicating with the ink supply port 507*m* is defined by the bottom wall 522, the cover 501, the first end wall 523, the second side wall 526, the partition wall 571 and the partition wall 572. The recess 521*c* communicating with the ink supply port 507*c* is defined by the bottom wall 522, the cover 501, the first end wall 523, the first side wall 525, the partition wall 571 and the partition wall 572. The recess 521*y* communicating with the ink supply port 507*y* is defined by the bottom wall 522, the cover 501, the second end wall 524, the first side wall 525, the partition wall 571 and the partition wall 573. In one modification, the partition wall 573 may be omitted. In this modified application, the recess 521*y* is defined by the bottom wall 522, the cover 501, the second end wall 524 the first side wall 525, the second side wall 526 and the partition wall 571.

As illustrated in FIGS. 14 to 18, the bottom wall 522, the first end wall 523, the second end wall 524, the first side wall 525, the second side wall 526, first convex ribs 528*a*, second convex ribs 528*b* and third convex ribs 528*c* of the casing 520 have the similar structures to those of the cartridge 4. The cartridge 5 has the circuit substrate 510 located on the second end wall 524-side of the casing 520. As in the structure of the cartridge 4, the circuit substrate 510 is fixed to a substrate mounting structure 511. The circuit substrate 510 has terminals 512 having substantially the similar structure to that of the cartridge 4. Contact portions of the respective terminals 512 are electrically connected with electrodes of the electrode assembly 810 provided on the carriage 8 when the cartridge 5 is attached to the carriage 8 as described above. The substrate mounting structure 511 has the similar structure to that of the cartridge 4. The circuit substrate 510 is fixed to the substrate mounting structure 511 by thermally caulking projections 514 protruded from the substrate mounting structure 511.

As illustrated in FIGS. 14 and 16, the cover 501 has a cover member 530 and an outward extension member 531. The cover member 530 is in a flat plate-like shape and is arranged to cover the recesses 521*m*, 521*c* and 521*y* of the casing 520. The outward extension member 531 is extended outward from the cover member 530 on the second end wall 524-side where the circuit substrate 510 with the terminals 512 is located, and includes a bent extension section 532 and an inclined extension section 533. The structure of these extension sections 532 and 533 is similar to the structure of the cartridge 4. The bent extension section 532 is bent at approximately 90 degrees to the cover member 530 and is extended to be protruded along a direction from the cover 501 toward the casing 520 (−Z direction in FIG. 16). The inclined extension section 533 continuous with the bent extension section 532 is extended to a location to hang over the terminals 512 of the circuit substrate 510 in the plan view of the cover 501 in the direction from the cover 501 toward the casing 520 (−Z direction in FIG. 16). In the state that the cover 501 is fixed to the casing 520, the outward extension member 531 is hung over an opening 513 of the substrate mounting structure 511 to close the opening 513 on the upper edge side of the first end wall 523 as shown in FIG. 18. In the state that the cover 501 is fixed to the casing 520, the outward extension member 531 is engaged with an engagement portion 505 as shown in FIG. 14. The outward extension member 531 is protruded to the outer side of at least the terminals 512 in the lower line of the circuit substrate 510 in a first direction from the first end wall 523 toward the second end wall 524 (+Y direction in FIGS. 8 and 16). In one modification, the inclined extension section 533 may be extended longer to be protruded to the outer side of all the terminals 512 of the circuit substrate 510.

As illustrated in FIG. 16, the cover 501 has through holes 502*a*, 502*b* and 502*c*, an air groove 503 arranged between the through hole 502*a* and the through hole 502*b* and an air communication hole 534 provided for each of the recesses 521*m*, 521*c* and 521*y* corresponding to the respective color inks, magenta, cyan and yellow, and seal member receiving elements 537 formed at respective corners of the cover 501. The seal member receiving elements 537 are protruded from the upper surface of the cover 501 to substantially the same height as the height of the circumferential walls of the through holes 502*a*, 502*b* and 502*c* and the circumferential walls of the air grooves 503 and serve as joint seat elements of the seal member 504.

The three air communication holes 534 are aligned in the X-axis direction in the outer periphery of the cover member 530 and are formed to pass through the cover 501. The through hole 502*b* provided for each of the color inks, yellow, magenta and cyan is formed to pass through the cover 501 at the end of the air groove 503 for each color ink and is arranged to be aligned in the Y-axis direction with corresponding one of the air communication holes 534 aligned in the X-axis direction. The air communication hole 534 and the corresponding through hole 502*b* aligned in the Y-axis direction are connected with each other by an air groove (not shown) on the rear surface of the cover 501. This air groove, the cover backside opening of the through hole 502*b* and the cover backside opening of the air communication hole 534 are sealed by a cover backside seal member 536. The recesses 521*m*, 521*c* and 521*y* of the casing 520 closed by the cover 501 are accordingly open to the air through the through holes 502*a*, the air grooves 503, the through holes 502*b* and the air communication holes 534. The through holes 502*a*, 502*b* and 502*c* and the air grooves 503 are sealed on the upper surface side of the cover 501 by the seal member 504. This arrangement of open to the air described above enables ink contained in the porous liquid retaining member 560 placed in the recess 521*m*, 521*c* or 521*y* for each color ink in the casing 520 closed by the cover 501 to be supplied to the supply port-side liquid retaining member 506 and then to the liquid introducing part 710*m*, the liquid introducing part 710*c* or the liquid introducing part 710*y* (FIG. 4) of the carriage 8 via the corresponding ink supply port 507*m*, 507*c* or 507*y*. In other words, the corresponding color inks are respectively supplied through the ink supply port 507*m* of the recess 521*m* to the liquid introducing part 710*m* of the carriage 8, through the ink supply port 507*c* of the recess 521*c* to the liquid introducing part 710*c* and through the ink supply port 507*y* of the recess 521*y* to the liquid introducing part 710*y*. The respective ink supply ports 507*m*, 507*c* and 507*y* have the following positional relationship.

In the plan view of the casing 520 or the cartridge 5 in a direction from the bottom wall 522 with the ink supply ports 507*m*, 507*c* and 507*y* toward the cover 501 (+Z direction), the ink supply port 507*m* is located between the first side wall 525 and the second side wall 526. The ink supply port 507*c* is located between the ink supply port 507*m* and the second side wall 526.

As shown in FIGS. 17 and 18, the cartridge 5 also has a first groove 580 and a second groove 581 on the bottom surface of the bottom wall 522 (outer wall surface on the −Z direction side) where the ink supply ports 507*m*, 507*c* and 507*y* are formed. The first groove 580 is formed between the ink supply port 507*m* corresponding to the liquid introducing part 710*m* for magenta and the ink supply port 507*c* corresponding to the liquid introducing part 710*c* for cyan (FIG. 4) and is extended from between the ink supply port 507*m* and the ink supply port 507*c* toward the ink supply port 507*y*. The first groove 580 is formed in the partition wall 572 as a concave having such a depth that the guide projection 723 (FIG. 4) of the cartridge attachment structure 7 is inserted in the state of attachment of the cartridge 5 to the cartridge attachment structure 7 and is extended over the length of the partition wall 572, i.e., between the second end wall 524 and the partition wall 571. The definition of "groove" includes not only a dent portion formed on the cartridge 5 but also a slot completely penetrates through the cartridge 5.

The surrounding side wall configuration of the casing and the arrangement of convex ribs of the cartridge 5 involved in positioning of the cartridge 5 to the cartridge attachment structure 7 mounted on the carriage 8 are substantially similar to those of the cartridge 4 described above.

A-5. Attachment of Cartridges

Figure 19:
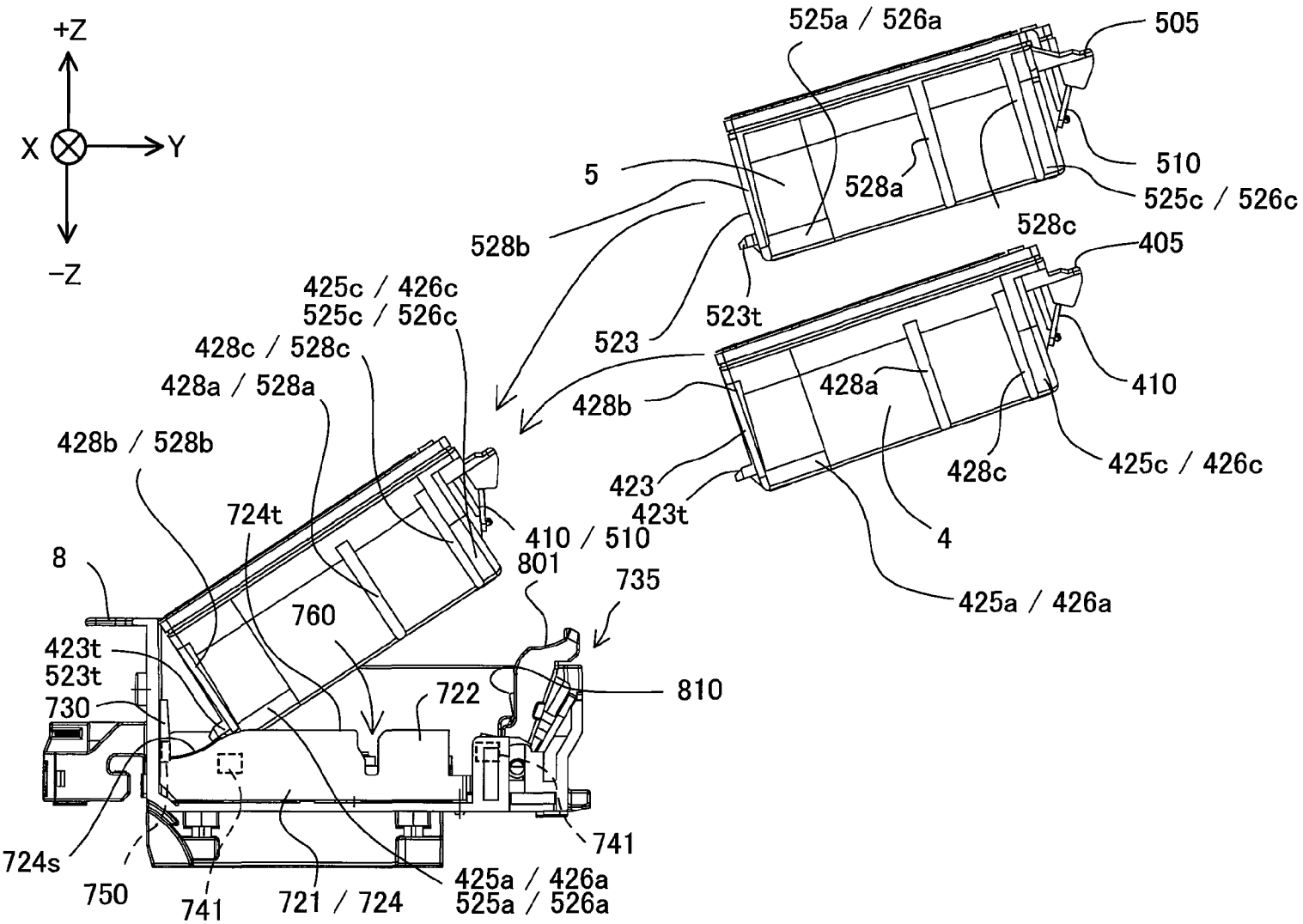
FIG. 19 is a diagram schematically illustrating a first step in the course of attachment of the cartridges of FIGS. 9 and 14 to the carriage.
Figure 20:
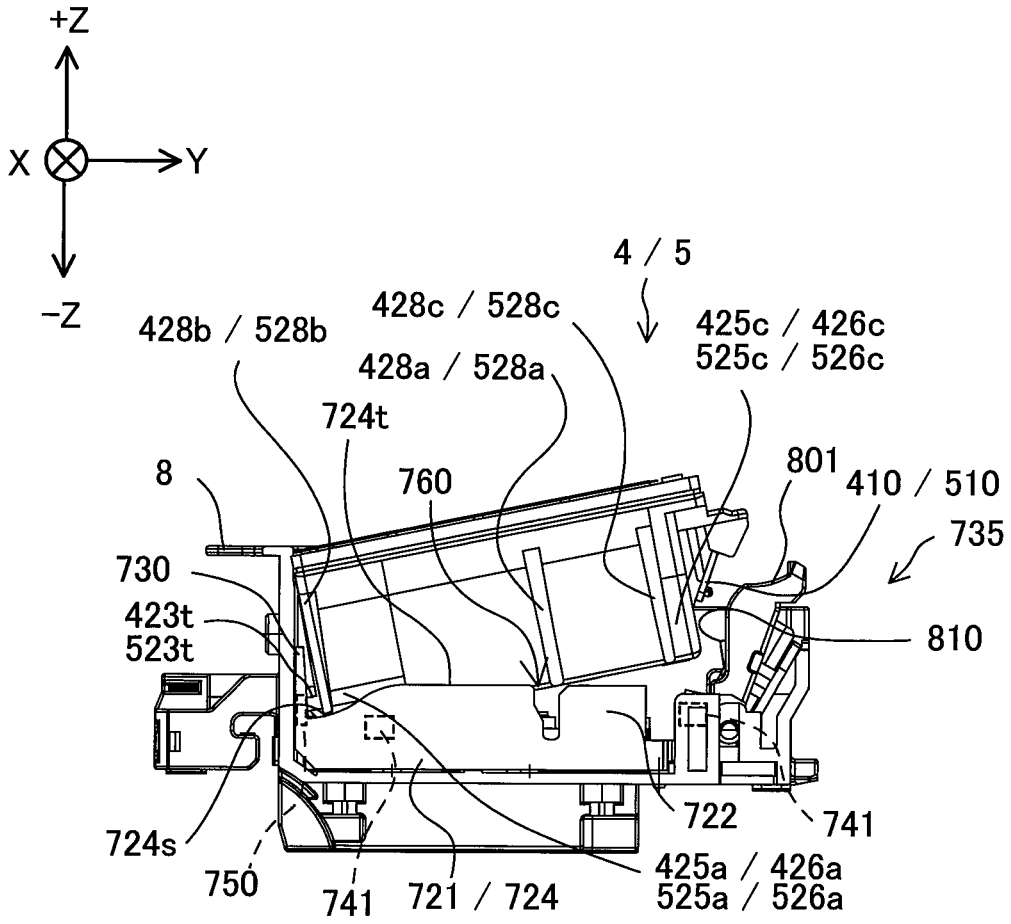
FIG. 20 is a diagram schematically illustrating a second step in the course of attachment of the cartridges to the carriage.
Figure 21:
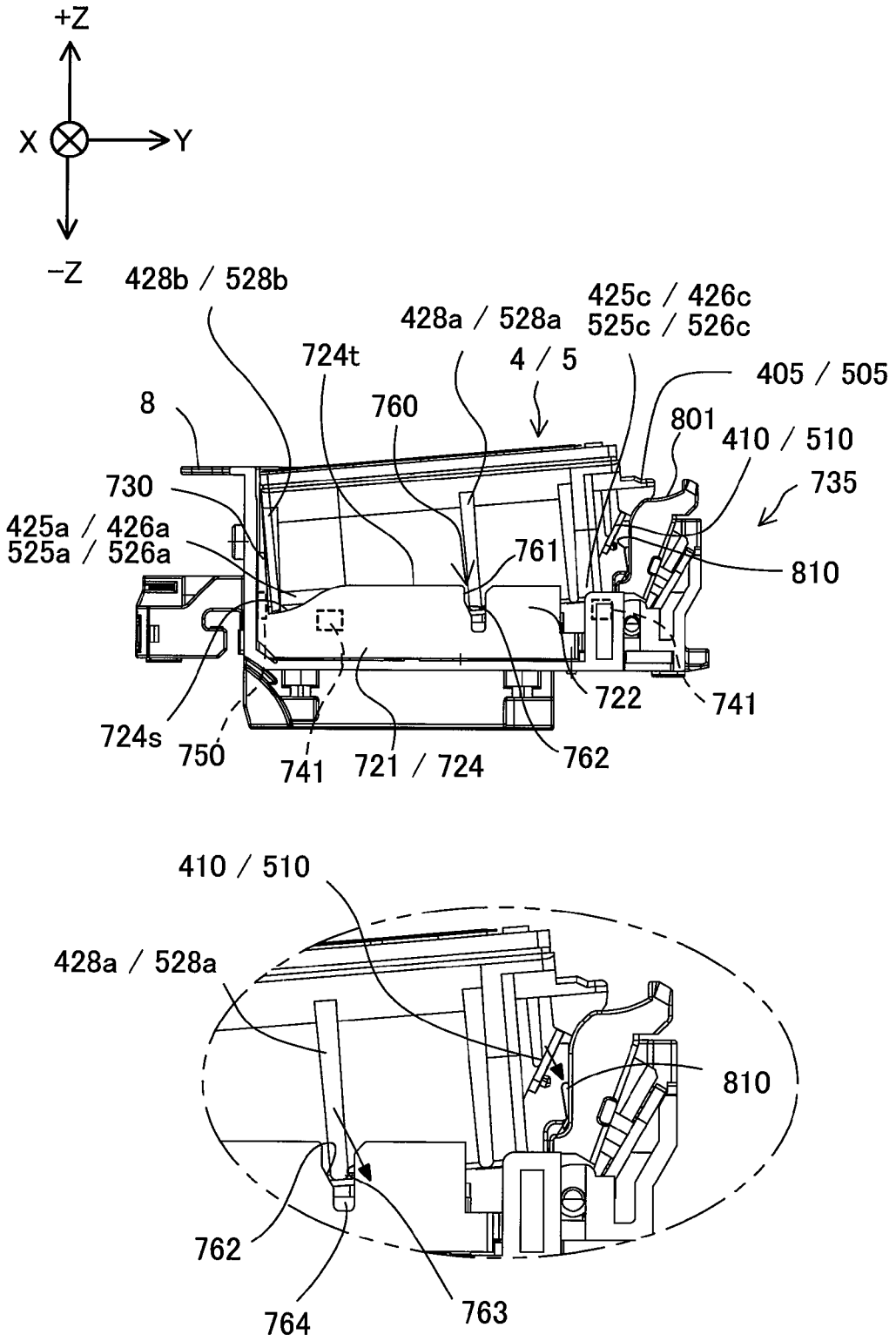
FIG. 21 is a diagram and a partly enlarged view schematically illustrating a third step in the course of attachment of the cartridges to the carriage.
Figure 22:
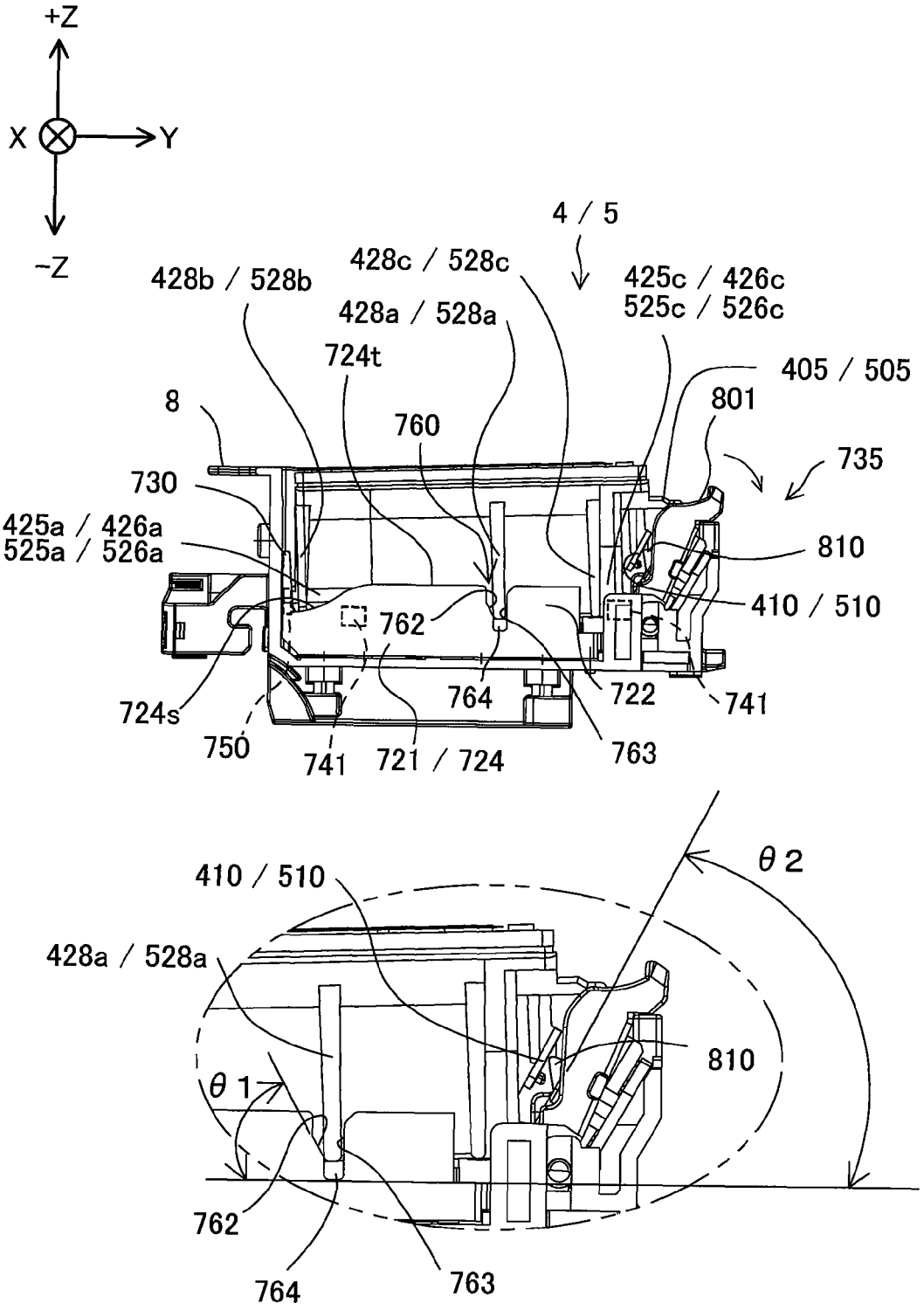
FIG. 22 is a diagram and a partly enlarged view schematically illustrating a fourth step in the course of attachment of the cartridges to the carriage.
Figure 23:
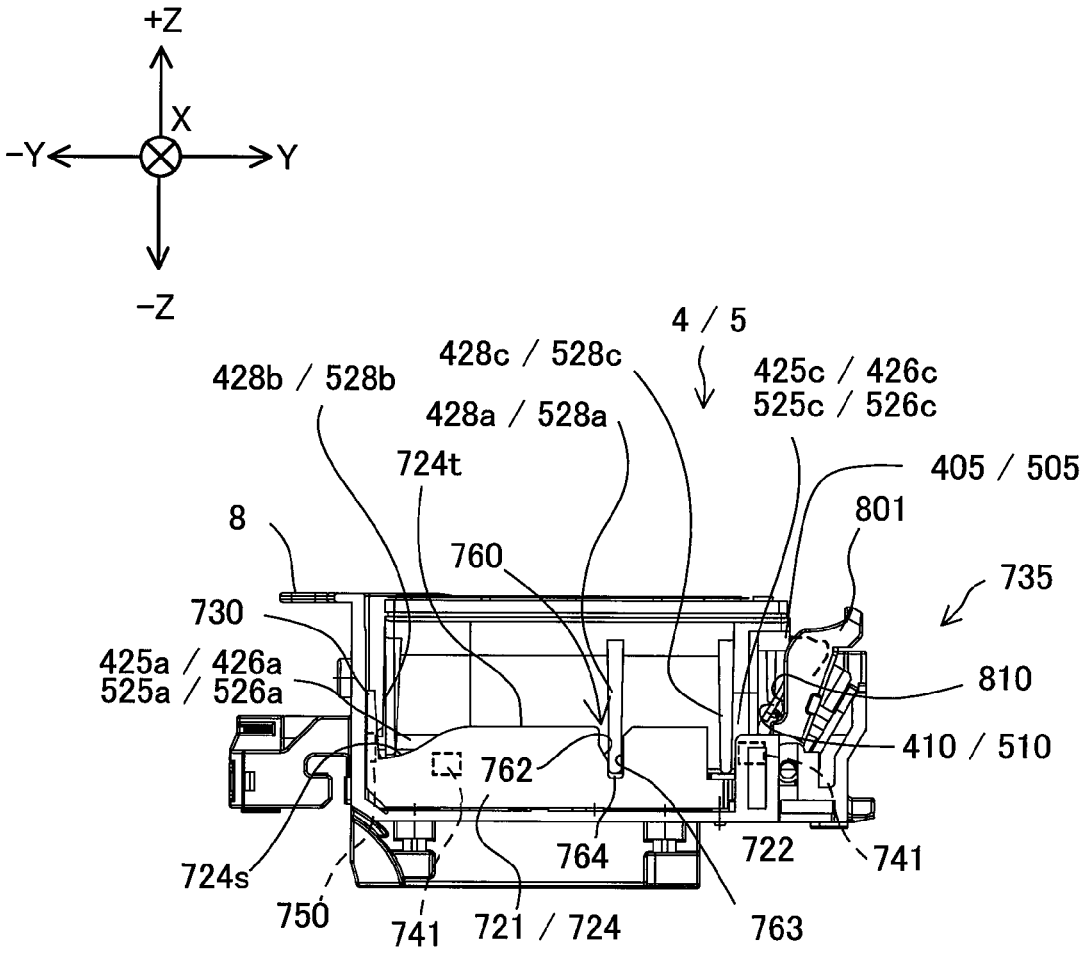
FIG. 23 is a diagram schematically illustrating a final step in the course of attachment of the cartridges to the carriage.

FIG. 19 is a diagram schematically illustrating a first step in the course of attachment of the cartridges 4 and 5 to the carriage 8. FIG. 20 is a diagram schematically illustrating a second step in the course of attachment of the cartridges 4 and 5 to the carriage 8. FIG. 21 is a diagram and a partly enlarged view schematically illustrating a third step in the course of attachment of the cartridges 4 and 5 to the carriage 8. FIG. 22 is a diagram and a partly enlarged view schematically illustrating a fourth step in the course of attachment of the cartridges 4 and 5 to the carriage 8. FIG. 23 is a diagram schematically illustrating a final step in the course of attachment of the cartridges 4 and 5 to the carriage 8.

In the first step of FIG. 19, both the cartridges 4 and 5 are inserted into the cartridge attachment structure 7 of the carriage 8 in such an inclined attitude that the outer wall surfaces of the first end walls 423 and 523 faces in the −Z direction. In this attachment step accompanied with insertion in the inclined attitude, the lower edges of the second convex ribs 428*b* and 528*b* on the first end wall 423-side and the first end wall 523-side of the cartridges 4 and 5 come into contact with the top surfaces 724*t* of the sidewall-side projections 724 and the inter-cartridge first projection 721. In this state, the cartridges 4 and 5 are pressed toward the end wall 730, so that the second convex ribs 428*b* and 528*b* abut against the top surfaces 724*t* and the continuing inclined top surfaces 724*s*. The cartridges 4 and 5 are then guided toward the end wall 730 along the locus on the top surfaces 724*t* and 724*s*.

In the second step of FIG. 20, the cartridges 4 and 5 are further pressed toward the end wall 730 while being kept in the inclined attitude. In this attachment step, the engagement projections 423*t* and 523*t* of the first end walls 423 and 523 of the cartridges 4 and 5 enter the engagement holes 750 in the cartridge attachment structure 7. This causes the first end walls 423 and 523 to be engaged with the end wall 730 of the cartridge attachment structure 7. This restricts the change in attitude of the cartridges 4 and 5 in the subsequent attachment step. More specifically, this suppresses the first end walls 423 and 523 of the cartridges 4 and 5 from being lifted up in the +Z direction.

In the third step of FIG. 21, subsequent to the engagement of the engagement projections 423*t* and 523*t* into the engagement holes 750, the lower edges of the second convex ribs 428*b* and 528*b* of the cartridges 4 and 5 come into contact with the lowest-height top surface parts of the inclined top surfaces 724*s* of the sidewall-side projections 724 and the inter-cartridge first projection 721 or more specifically with the top surfaces of the joints with the end wall 730. This restricts the change in attitude of the first end walls 423 and 523 of the cartridges 4 and 5 in the −Z direction. The first convex ribs 428*a* and 528*a* of the cartridges 4 and 5 then enter the cartridge engagement wall surfaces 760. The first convex ribs 428*a* and 528*a* first abut against the second wall surfaces 762 of the cartridge engagement wall surfaces 760 inclined with respect to the bottom wall 712 of the cartridge attachment structure 7 (FIG. 6). The first convex ribs 428*a* and 528*a* subsequently friction the second wall surfaces 762 and move in a moving direction shown by an arrow in the enlarged view of FIG. 21. The contact portions of the terminals 412 and 512 of the circuit substrates 410 and 510 then approach in the same direction as this moving direction to come into contact with the electrode assemblies 810. The first side wall parts 425*a* and 525*a* of the cartridges 4 and 5 are engaged with the cartridge first engagement protrusions 741 (FIGS. 4 and 5) formed to face each other on the engagement hole 750-side in the cartridge attachment structure 7 having the liquid introducing parts 710*b*, 710*m*, 710*c* and 710*y*.

In the fourth step of FIG. 22, in the state that the contact portions of the terminals 412 and 512 of the circuit substrates 410 and 510 are in contact with the electrode assemblies 810, the cartridges 4 and 5 are pressed in the −Z direction toward the cartridge attachment structure 7. In this step, the cartridge engagement arms 801 are pressed by the engagement portions 405 and 505 to move in the direction of an arrow illustrated in the drawing (+Y direction). After attachment of the cartridges 4 and 5 to the cartridge attachment structure 7, the cartridge engagement arms 801 move in the −Y direction and are returned to their original positions to be engaged with the engagement portions 405 and 505 as shown in FIG. 23. In this process, the third side wall parts 425*c* and 525*c* are engaged with the cartridge second engagement protrusions 742 (FIGS. 4 and 5) formed to face each other on the electrode mounting structure 735-side of the carriage 8. Subsequent to abutting against the second wall surfaces 762 of the cartridge engagement wall surfaces 760, the first convex ribs 428*a* and 528*a* start abutting against the perpendicular wall surfaces surrounding the concaves 764. The lower edges of the first convex ribs 428*a* and 528*a* then enter the concaves 764. The contact portions of the terminals 412 and 512 of the circuit substrates 410 and 510 friction the electrode assemblies 810, i.e., wipe the electrode assemblies 810. Wiping is completed when the lower edges of the first convex ribs 428*a* and 528*a* abut against the bottoms of the concaves 764. The positional changes of the cartridges 4 and 5 are controlled by the first convex ribs 428*a* and 528*a* coming into contact with the wall surfaces of the cartridge engagement wall surfaces 760.

The moving direction shown by the arrow in the enlarged view of FIG. 21 is shown in the enlarged view of FIG. 22. The moving direction depends on an angle θ1 of the second wall surface 762 of the cartridge engagement wall surface 760 with respect to the bottom wall 712 of the cartridge attachment structure 7. In the state that the total of this angle θ1 and an angle θ2 of the electrode assembly 810 of the carriage 8 with respect to the bottom wall 712 of the cartridge attachment structure 7 is approximately 90 degrees, when the contact portions of the terminals 412 and 512 of the circuit substrates 410 and 510 approach to and come into contact with the electrode assemblies 810 in the third step, the contact portions of the terminals 412 and 512 have only a small moving distance in friction with the electrode assemblies 810. In the state that the total of the angles θ1 and θ2 is greater than 90 degrees, on the other hand, the contact portions of the terminals 412 and 512 have a large moving distance in friction with the electrode assemblies 810 in the third step.

In the final step of FIG. 23, the engagement portions 405 and 505 are engaged with the cartridge engagement arms 801. When the cartridges 4 and 5 are pressed in the −Z direction toward the cartridge attachment structure 7, the cartridges 4 and 5 are lifted up in the +Z direction by the reactive forces from the liquid introducing parts 710 and the electrode assemblies 810. The cartridge engagement arm 810 are accordingly engaged with the engagement portions 405 and 505. The cartridges 4 and 5 are also pressed in the −Y direction by the reactive force from the electrode assemblies 810. The first convex ribs 428*a* and 528*a* abutting against the perpendicular wall surfaces surrounding the concaves 764 restrict the motions of the cartridges 4 and 5 in the −Y direction. The first convex ribs 428*a* and 528*a* are kept in contact with the perpendicular wall surfaces surrounding the bottoms of the concaves 764. The combination of such contact with the engagement of the cartridge engagement arms 801 with the engagement portions 405 and 505 keeps the contact portions of the terminals 412 and 512 of the circuit substrates 410 and 510 in contact with the electrode assemblies 810. This completes attachment of the cartridges 4 and 5 to the cartridge attachment structure 7 of the carriage 8. The cartridges 4 and 5 are then in the attachment attitude shown in FIG. 23.

In the course of attachment of the cartridges 4 and 5 of the embodiment having the above configurations to the cartridge attachment structure 7 of the carriage 8, the first convex ribs 428*a* and 528*a* enter the cartridge engagement wall surfaces 760, subsequent to the engagement of the engagement projections 423*t* and 523*t* into the engagement holes 750 (FIG. 21: second step). In the cartridges 4 and 5 of the embodiment, the first convex ribs 428*a* and 528*a* abut against the second wall surfaces 762 of the cartridge engagement wall surface 760 inclined with respect to the bottom wall 712 of the cartridge attachment structure 7 (FIG. 6) and move in friction with the second wall surfaces 762. Accordingly, the contact portions of the terminals 412 and 512 of the circuit substrates 410 and 510 approach to and come into contact with the electrode assemblies 810 (FIG. 22: third step).

The first convex ribs 428*a* and 528*a* of the cartridges 4 and 5 of the embodiment further enter the bottoms of the concaves 764. This causes the contact portions of the terminals 412 an 512 of the circuit substrates 410 and 510 to move in friction with the electrode assemblies 810 after the contact of the terminals 412 and 512 come into contact with the electrode assemblies 810 of the carriage 8. The lower edges of the first convex ribs 428*a* and 528*a* abutting against the bottoms of the concaves 764 restrict the range of friction of the contact portions, i.e., the distance of wiping, to a predetermined range. As a result, the cartridges 4 and 5 of the embodiment have the enhanced accuracy of wiping in the course of attachment and enable the contact portions of the terminals 412 and 512 of the circuit substrates 410 and 510 to be electrically connected with the electrode assemblies 810 with high reliability.

In the cartridges 4 and 5 of the embodiment, the first convex ribs 428*a* and 528*a* entering the bottoms of the concaves 764 prevent further positional changes of the circuit substrates 410 and 510 and limit the displacement amounts of the positional changes of the circuit substrates 410 and 510. This does not unnecessarily widen the wiping range in the cartridges 4 and 5 of the embodiment. This does not need significant attitude changes of the cartridges 4 and 5 in the course of attachment and thereby enhance the attachment. This also reduces potential damages of the circuit substrates 410 and 510 and the electrode assemblies 810 caused by wiping in the wide range.

The cartridges 4 and 5 of the embodiment enhance the accuracy of wiping by the simple technique that the first convex ribs 428*a* and 528*a* enter the cartridge engagement wall surfaces 760 and abut against the wall surfaces of the cartridge engagement wall surfaces 760.

In the cartridges 4 and 5 of the embodiment, the engagement projections 423*t* and 523*t* are inserted into the engagement holes 750, so that the first end walls 423 and 523 are engaged with the end wall 730 of the cartridge attachment structure 7. The first convex ribs 428*a* and 528*a* then enter the concaves 764 of the cartridge engagement wall surfaces 760 to come into contact with the wall surfaces of the cartridge engagement wall surfaces 760. The cartridges 4 and 5 of the embodiment readily allows for wiping with high accuracy by the sequential steps that the first end walls 423 and 523 are engaged with the end wall 730 and that the first convex ribs 428*a* and 528*a* subsequently enter the cartridge engagement wall surfaces 760.

In the cartridges 4 and 5 of the embodiment, as shown in FIG. 22, the moving direction of the first convex ribs 428*a* and 528*a* which abut against the second wall surfaces 762 and subsequently move in friction with the second wall surfaces 762 is set equal to the direction in which the contact portions of the terminals 412 and 512 of the circuit substrates 410 and 510 approach to the electrode assemblies 810. The cartridges 4 and 5 of the embodiment thus further increase the accuracy of the positions where the contact portions of the terminals 412 and 512 of the circuit substrates 410 and 510 come into contact with the electrode assemblies 810 and allows for subsequent winding more effectively and more easily.

In the cartridges 4 and 5 of the embodiment, the first convex ribs 428*a* and 528*a* come into contact with the perpendicular wall surfaces surrounding the concaves 764. This allows for positioning of the respective cartridges 4 and 5 of the embodiment in the Y direction, while ensuring wiping of the cartridges 4 and 5.

The cartridges 4 and 5 of the embodiment have the second convex ribs 428*b* and 528*b* on the first end wall 423-side and on the first end wall 523-side. The lower edges of the second convex ribs 428*b* and 528*b* come into contact with the top surfaces 724*t* and the continuing inclined top surfaces 724*s* of the sidewall-side projections 724 and the inter-cartridge first projection 721 in the initial stage of attachment (FIG. 21). The cartridges 4 and 5 of the embodiment are thus guided along the locus on these top surfaces 724*t* and 724*s* in the course of attachment by the second convex ribs 428*b* and 528*b* abutting against the top surfaces 724*t* and the continuing inclined top surfaces 724*s*. Using the top surfaces 724*t* and 724*s* as the guide enhances the attachment.

The cartridges 4 and 5 of the embodiment have the third convex ribs 428*c* and 528*c* on the circuit substrate 410-side and on the circuit substrate 510-side opposite to the second convex ribs 428*b* and 528*b*. As shown in FIGS. 10 and 15, the distance between the first convex rib 428*a* or 528*a* and the second convex rib 428*b* or 528*b* is made different from the distance between the first convex rib 428*a* or 528*a* and the third convex rib 428*c* or 528*c*. No problem thus arises in the course of attachment to the cartridge attachment structure 7 in the attitude that the second convex ribs 428*b* and 528*b* are located on the end wall 730-side. In the attitude that the third convex ribs 428*c* and 528*c* are located on the end wall 730-side, however, the first convex ribs 428*a* and 528*a* do not enter the cartridge engagement wall surfaces 760 but interfere with the top surfaces 724*t* of the sidewall-side projections 724. This prevents wrong attachment of the cartridges 4 and 5 of the embodiment.

The cartridges 4 and 5 of the embodiment have the first convex ribs 428*a* and 528*a*, the second convex ribs 428*b* and 528*b* and the third convex ribs 428*c* and 528*c* on the second side walls 426 and 526, in addition to on the first side walls 425 and 525. In the cartridges 4 and 5 of the embodiment, the attitude change is restricted for the purpose of wiping via insertion of the first convex ribs 428*a* and 528*a* into the cartridge engagement wall surfaces 760 on both the first side walls 425 and 525 and the second side walls 426 and 526. This allows for wiping with high accuracy.

B. Modifications

The invention may be implemented by any of various aspects described below.

B-1. First Modification of Appearance of Cartridge

Figure 24:
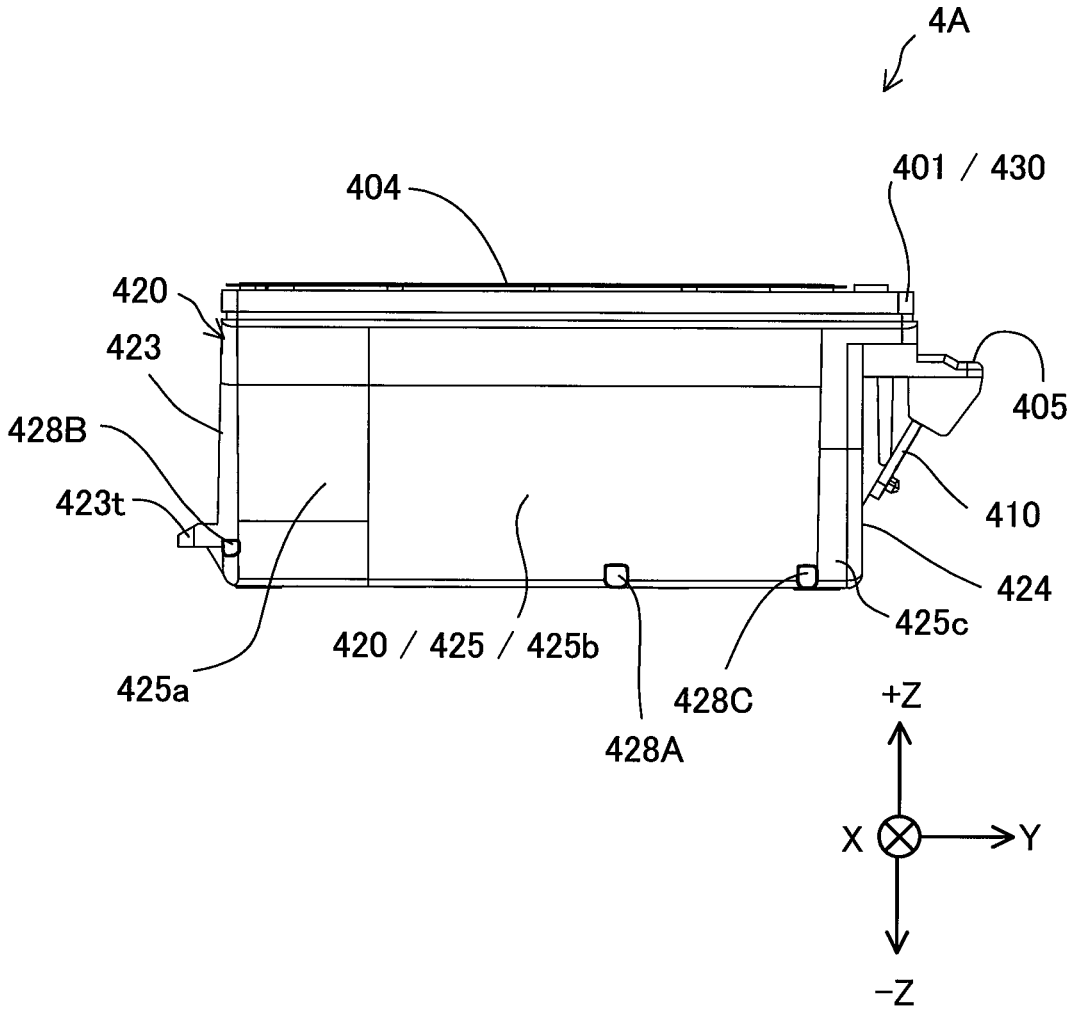
FIG. 24 is a side view illustrating a cartridge of a first modification, viewed in the X direction.

This modification is characterized by changing the shapes of the first convex ribs 428*a* and 528*a*, the second convex ribs 428*b* and 528*b* and the third convex ribs 428*c* and 528*c* from the convex ribs to the projections. FIG. 24 is a side view illustrating a cartridge 4A of a first modification, viewed in the X direction. As illustrated, this cartridge 4A has first projections 428A, second projections 428B and third projections 428C on a first side wall 425 and on a second side wall 426 (not shown) opposed to the first side wall 425. The first projections 428A are provided at the locations corresponding to the lower edges of the first convex ribs 428*a* and are protruded in the X-axis direction from the first side wall 425 and from the second side wall 426 by a height corresponding to the height of the first convex ribs 428*a* in the −X direction from the first side wall 425 and from the second side wall 426. The lower edge shape of the first projection 428A in the plan view of the first side wall 425 in the +X direction in FIG. 24 is equal to the lower edge shape of the first convex rib 428*a* in the plan view of the first side wall 425 in the +X direction in FIG. 10. Similarly the second projections 428B and the third projections 428C have the heights in the −X direction from the first and the second side walls 425 and 426 and the lower edge shapes similar to those of the second convex ribs 428*b* and the third convex ribs 428*c*. The cartridge 4A of the first modification accordingly has similar advantageous effects to those of the cartridge 4 described above. The lower edge shape of, for example, the first projections 428A may not be similar to the lower edge shape of, for example, the first convex ribs 428*a* of the cartridge 4. The respective projections may be formed in, for example, a cylindrical shape, a shape of triangular prism or a shape of quadratic prism. This description is also applicable to a modification of the cartridge 5.

B-2. Second Modification of Appearance of Cartridge

Figure 25:
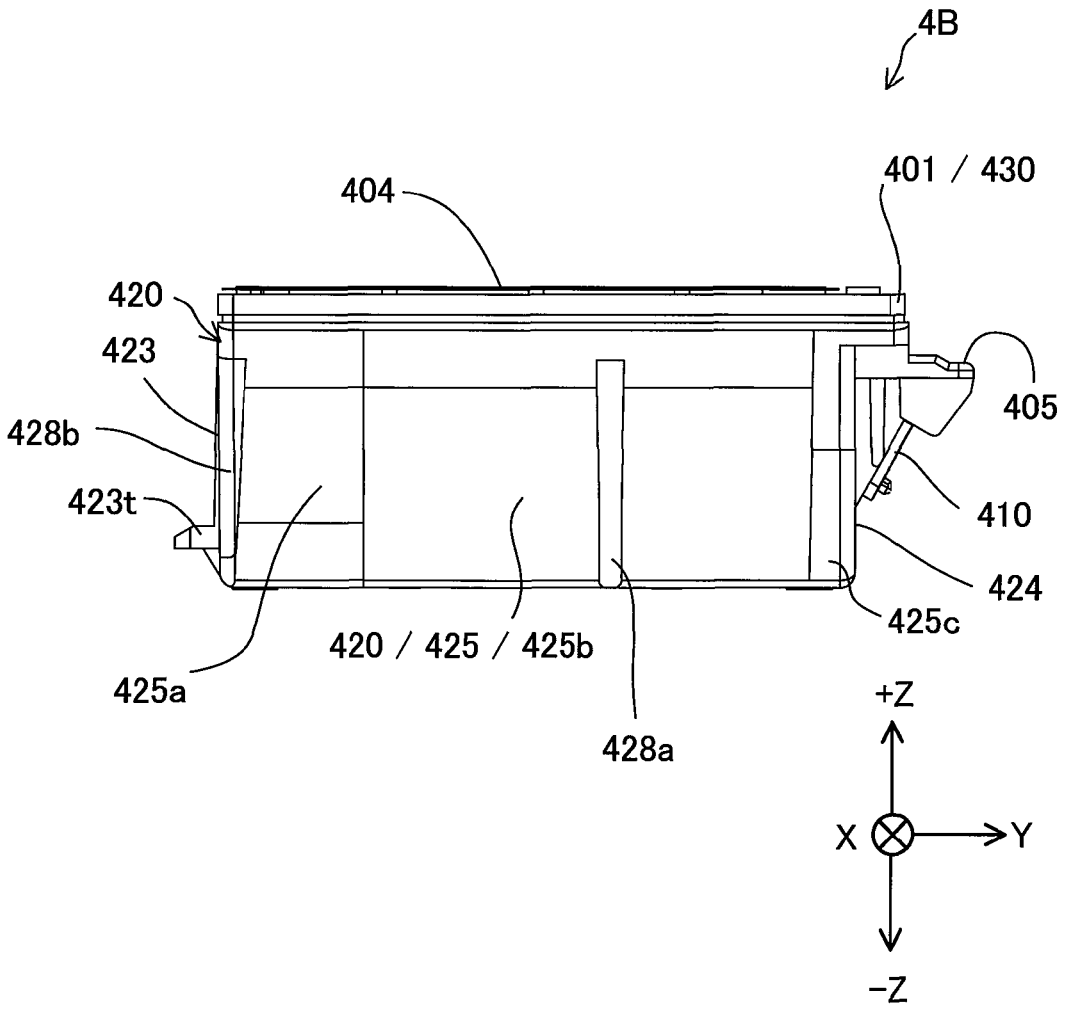
FIG. 25 is a side view illustrating a cartridge of a second modification, viewed in the X direction.

FIG. 25 is a side view illustrating a cartridge 4B of a second modification, viewed in the X direction. As illustrated, like the cartridge 4 described above, this cartridge 4B has the first convex ribs 428*a* and the second convex ribs 428*b* on the first side wall 425 and the second side wall 426 opposed to the first side wall 425 but does not have the third convex ribs 428*c*. This cartridge 4B has the advantageous effects on wiping described above. The cartridge 5 may have a similar modification.

B-3. Third Modification of Appearance of Cartridge

Figure 26:
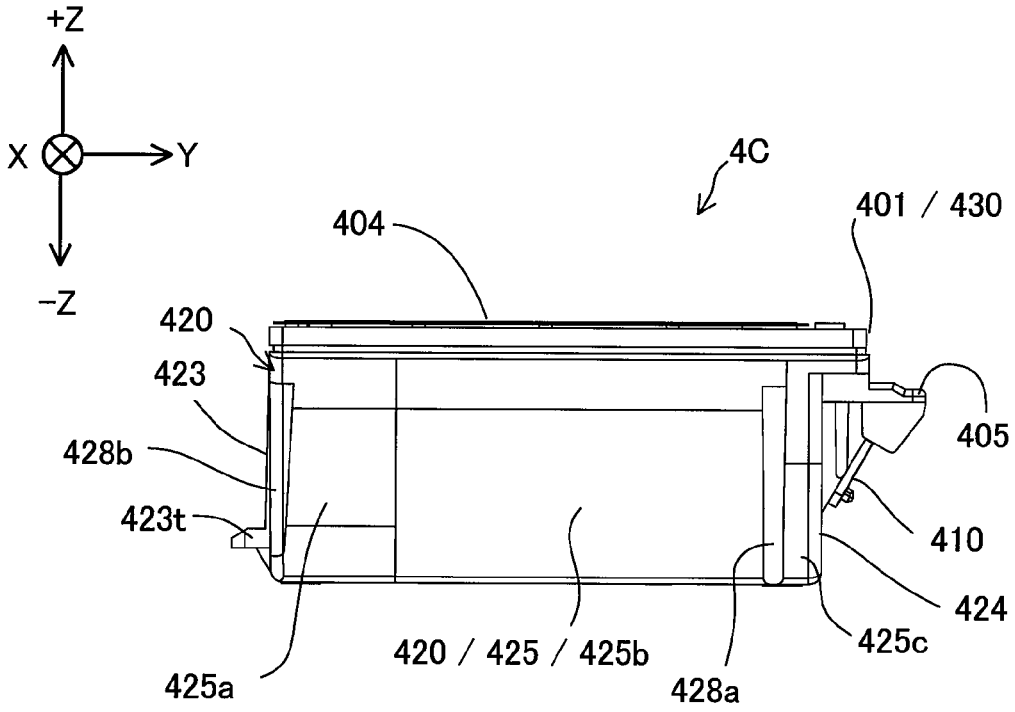
FIG. 26 is side views illustrating a cartridge of a third modification and a cartridge attachment structure of the third modification, viewed in the X direction.
Figure 26:
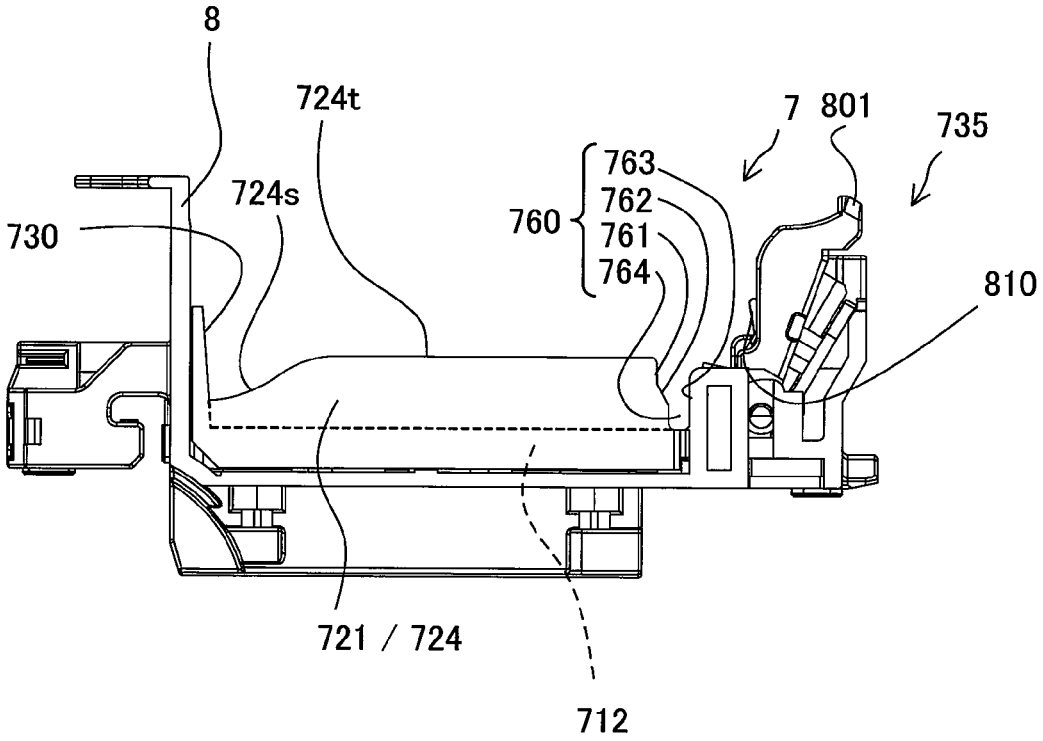

FIG. 26 is side views illustrating a cartridge 4C of a third modification and a cartridge attachment structure 7 of the third modification, viewed in the X direction. As illustrated, this cartridge 4C does not have the third convex ribs 428*c* like the above second modification but has the first convex ribs 428*a* at the positions where the third convex ribs 428*c* are placed in the embodiment described above. Accordingly, in the cartridge attachment structure 7, the cartridge engagement wall surface 760 is provided on the electrode mounting structure 735-side. This cartridge 4C has the advantageous effects on wiping described above. The first convex ribs 428*a* may also be used as the third convex ribs 428*c* for preventing wrong attachment. The cartridge 5 may have a similar modification.

B-4. Fourth Modification of Appearance of Cartridge

Figure 27:
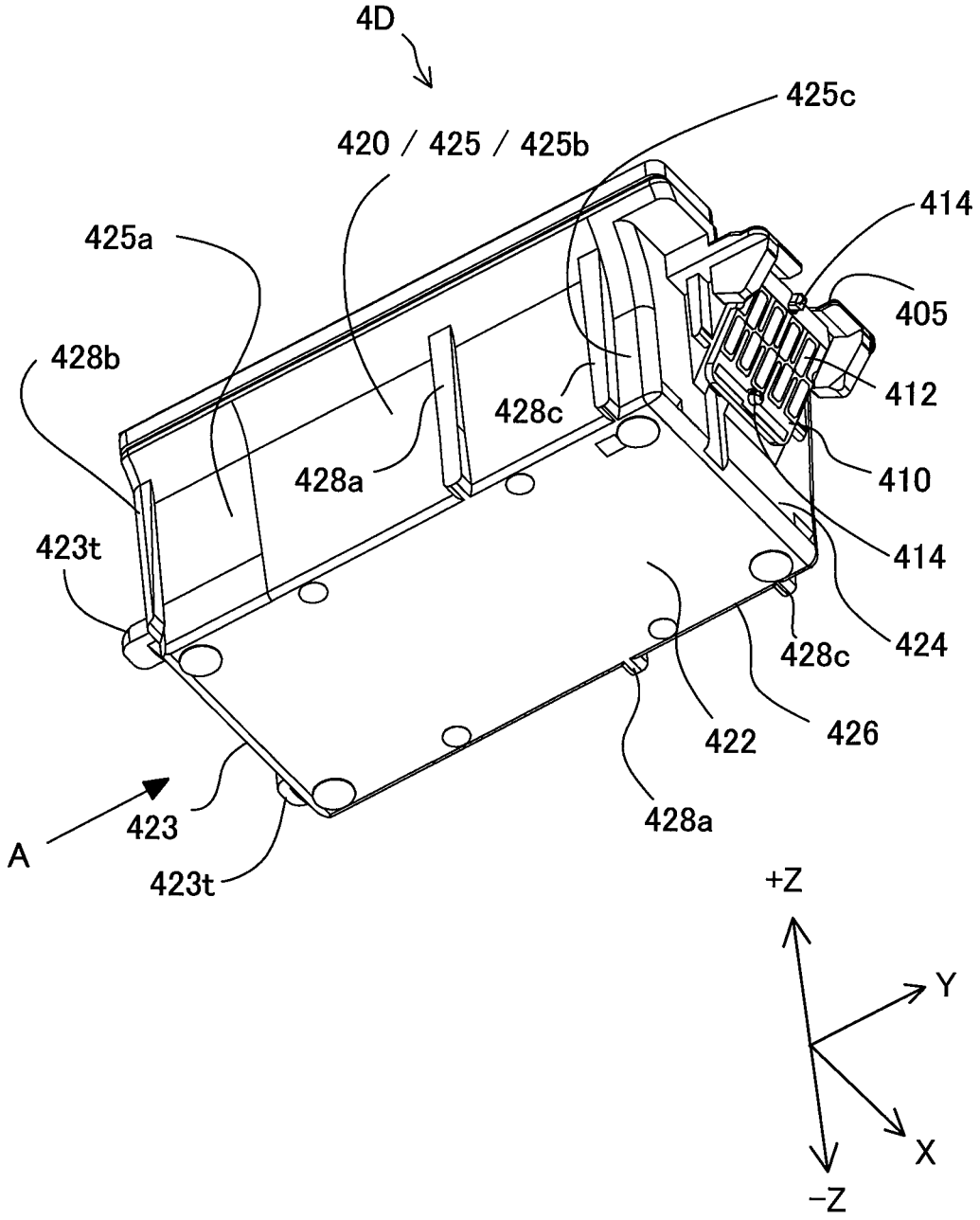
FIG. 27 is an appearance perspective view illustrating a cartridge of a fourth modification, viewed from the bottom side.
Figure 28:
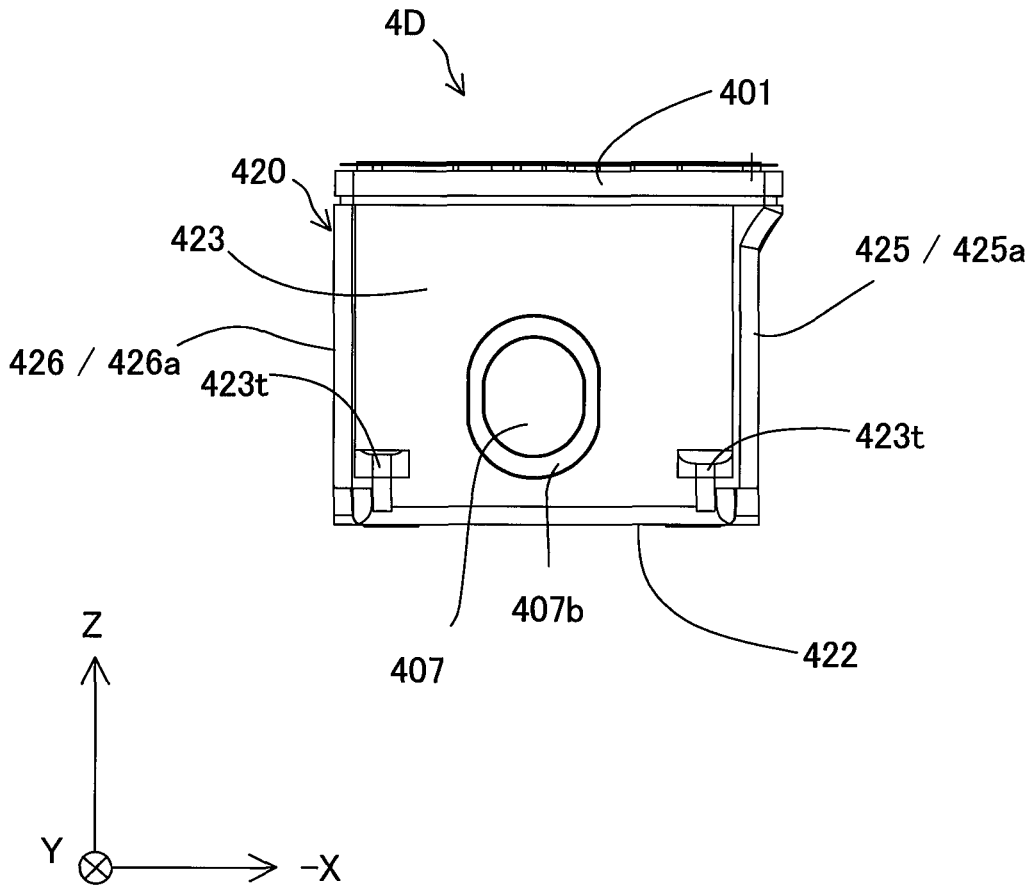
FIG. 28 is a side view illustrating the cartridge of the fourth modification, viewed in the Y direction.

This modification has a liquid supply port 407 at a different position from the bottom wall 422. FIG. 27 is an appearance perspective view illustrating a cartridge 4D of a fourth modification, viewed from the bottom side. FIG. 28 is a side view illustrating the cartridge 4D of the fourth modification, viewed in the Y direction. As illustrated, like the cartridge 4 described above, this cartridge 4D has the first convex ribs 428*a*, the second convex ribs 428*b* and the third convex ribs 428*c* on the first side wall 425 and the second side wall 426 opposed to the first side wall 425. The liquid supply port 407 and the surrounding peripheral concaved area 407*b* are formed in the first end wall 423. This cartridge 4D has the similar advantageous effects to those of the cartridge 4 described above. In a modification of the cartridge 5, the liquid supply port 507*m* and the peripheral concaved area 507*b* for magenta ink and the liquid supply port 507*c* and the peripheral concaved area 507*b* for cyan ink may be formed in the first end wall 523.

B-5. Other Modifications

The present invention is not limited to the inkjet printer or its ink cartridges but is also applicable to any liquid ejection device configured to eject another liquid but ink and a cartridge (liquid container) configured to contain another liquid. For example, the invention may be applied to any of various liquid ejection devices and their liquid containers:

(1) image recording device, such as a facsimile machine;

(2) color material ejection device used to manufacture color filters for an image display device, e.g., a liquid crystal display;

(3) electrode material ejection device used to form electrodes of, for example, an organic EL (electroluminescence) display and a field emission display (FED);

(4) liquid ejection device configured to eject a bioorganic material-containing liquid used for manufacturing biochips;

(5) sample ejection device used as a precision pipette;

(6) ejection device of lubricating oil;

(7) ejection device of a resin solution;

(8) liquid ejection device for pinpoint ejection of lubricating oil on precision machines such as watches or cameras;

(9) liquid ejection device configured to eject a transparent resin solution, such as an ultraviolet curable resin solution, onto a substrate in order to manufacture a hemispherical microlens (optical lens) used for, for example, optical communication elements;

(10) liquid ejection device configured to eject an acidic or alkaline etching solution in order to etch a substrate or the like; and

(11) liquid ejection device equipped with a liquid ejection head for ejecting a very small volume of droplets of any other liquid.

The "droplet" herein means the state of liquid ejected from the liquid ejection device and may be in a granular shape, a teardrop shape or a tapered threadlike shape. The "liquid" herein may be any material ejectable by the liquid ejection device. The "liquid" may be any material in the liquid phase. For example, liquid-state materials of high viscosity or low viscosity, liquid materials in sol-gel process and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The ink herein includes general water-based inks and oil-based inks, as well as various liquid compositions, such as gel inks and hot-melt inks.

The invention is not limited to any of the embodiments, the examples and the modifications described herein but may be implemented by a diversity of other configurations without departing from the scope of the invention. For example, the technical features of the embodiments, examples or modifications corresponding to the technical features of the respective aspects described in Summary may be replaced or combined appropriately, in order to solve part or all of the problems described above or in order to achieve part or all of the advantageous effects described above. Any of the technical features may be omitted appropriately unless the technical feature is described as essential herein.

What is claimed is:

1. A liquid supply unit mountable to and demountable from an attachment structure, the attachment structure including a bottom wall, an end wall arranged to intersect with the bottom wall, a side wall arranged to intersect with the bottom wall and the end wall, the side wall having a groove indented opposite to an upward Z-direction perpendicular to the bottom wall, the groove including a wider top, a narrower bottom, and an inclined wall surface, and the side wall having an inclined surface including a gradually decreasing height from the bottom wall on a side of the end wall, and an electrode assembly provided at a position opposed to the end wall, the liquid supply unit comprising:

a first surface member facing the bottom wall, when in an attachment state in which the liquid supply unit is attached to the attachment structure;

a second surface member facing the side wall, in the attachment state;

a third surface member facing the end wall, in the attachment state;

a fourth surface member intersecting the first surface member and the second surface member, and opposed to the third surface member;

and inclined surface member extending outward and upward on from the fourth surface; and a contact portion electrically connectable with the electrode assembly, the contact portion provided on the inclined surface member, wherein the second surface member has a first projection, the first projection is configured to be received into the groove in the attachment state, and the second surface member has a second projection located closer to the third surface member than the first projection.

2. The liquid supply unit according to claim 1, wherein the first projection is configured to come to contact with the inclined wall surface of the groove, and the second projection is configured to come to contact with the inclined surface, in the course of attaching the liquid supply unit to the attachment structure.

3. The liquid supply unit according to claim 1, wherein the third surface member has an engagement portion configured to engage with the end wall of the attachment structure, and the first projection is configured to enter into the groove after the engagement of the engagement portion with the end wall.

4. The liquid supply unit according to claim 2, wherein the second surface member has a third projection, and the third projection is located further from the third wall surface member than is the first projection.

5. The liquid supply unit according to claim 4, wherein a distance from the first surface member to the second projection is greater than a distance from the first surface member to the third projection.

6. The liquid supply unit according to claim 1, further comprising:

a fifth surface member opposed to the second surface member, wherein the fifth surface member has a fourth projection, the fourth projection is configured to be received into another groove provided on another side wall of the attachment structure and indented opposite to the Z-direction perpendicular to the bottom wall and including a wider top and a narrower bottom, in the attachment state; and the fifth surface member has a fifth projection located closer to the third surface member than is the fourth projection.

7. The liquid supply unit according to claim 6, wherein the fourth projection is configured to come into contact with the inclined wall surface of the other groove in the other side wall of the attachment structure, in the course of attaching the liquid supply unit to the attachment structure, and the fifth projection is configured to come to contact with the other inclined surface provided on the other side wall of the attachment structure and including a gradually decreasing height from the bottom wall on a side of the end wall, in the course of attaching the liquid supply unit to the attachment structure.

8. The liquid supply unit according to claim 6, wherein the fifth surface member has a sixth projection, and the sixth projection is located farther from the third surface member than is the fourth projection.

9. The liquid supply unit according to claim 8, wherein a distance from the first surface member to the fifth projection is greater than a distance from the first surface member to the sixth projection.

10. A combination of a liquid supply unit and an attachment structure, the attachment structure comprising:

a bottom wall;

an end wall arranged to intersect with the bottom wall;

a side wall intersecting the bottom wall and the end wall, the side wall having a groove indented opposite to an upward Z-direction perpendicular to the bottom wall, the groove including a wider top, a narrower bottom, and an inclined wall surface, and the side wall having a inclined surface including a gradually decreasing height from the bottom wall on a side of the end wall; and an electrode assembly provided at a position opposed to the end wall; and in the state of attachment to the attachment structure, the liquid supply unit comprising:

a first surface member facing the bottom wall;

a second surface member facing the side wall;

a third surface member facing the end wall;

a fourth surface member intersecting the first surface member and the second surface member, and opposed to the third surface member;

and inclined surface member extending outward and upward from the fourth surface member; and a contact portion electrically connected with the electrode assembly, the contact portion provided on the inclined surface member, wherein the second surface member has a first projection, the first projection is received into the groove, and the second surface member has a second projection located closer to the third surface member than is the first projection, the second projection in contact with the inclined surface.

11. The combination according to claim 10, wherein the third surface member has an engagement portion that engages with the end wall.

12. The combination according to claim 10, wherein the second surface member has a third projection, and the third projection is located farther from the third surface member than is the first projection.

13. The combination according to claim 11, wherein the second surface member has a third projection, and the third projection is located farther from the third surface member than is the first projection.

14. The combination according to claim 13, wherein a distance from the first surface member to the second projection is greater than a distance from the first surface member to the third projection.

15. The combination according to claim 10, wherein the attachment structure includes another sidewall and another groove provided on the other side wall, the other groove is indented opposite to a Z-direction perpendicular to the bottom wall and the other groove has a wider top and a narrower bottom; and the liquid supply unit includes a fifth surface member opposed to the second surface member, the fifth surface member has a fourth projection, and the fourth projection is received into the other groove.

* * * * *